US005488815A

United States Patent [19]

Abrams et al.

[11] Patent Number: 5,488,815

[45] Date of Patent: Feb. 6, 1996

[54] APPARATUS AND METHOD FOR STERILIZATION AND SECONDARY PACKAGING

[75] Inventors: Richard W. Abrams, Jacksonville; Ben A. Hutchinson, Atlantic Beach, both of Fla.; David M. Maroukis, Huntersville, N.C.; Claude E. Monsees, Fort Mill, S.C.

[73] Assignee: Johnson & Johnson Vision Products, Inc., Jacksonville, Fla.

[21] Appl. No.: 257,788

[22] Filed: Jun. 10, 1994

[51] Int. Cl.[6] ..... A61L 2/00; B65B 55/12; B65B 35/30

[52] U.S. Cl. ..... 53/425; 53/251; 53/252; 53/467; 53/544; 53/566; 422/304

[58] Field of Search ..... 53/425, 426, 467, 53/428, 449, 249, 250, 251, 252, 247, 566, 564, 544, 540, 541, 537, 531, 534, 258, 255, 502, 136.1, 135.1; 422/304, 300, 303, 302

[56] References Cited

U.S. PATENT DOCUMENTS

| | | | |
|---|---|---|---|
| 1,950,304 | 3/1934 | High | 53/425 X |
| 2,883,262 | 4/1959 | Borin | 53/425 |
| 3,606,995 | 9/1971 | Van Den Hemel | 53/425 X |
| 4,691,820 | 9/1987 | Martinez | 206/205 |
| 5,122,340 | 6/1992 | Shimamura et al. | 53/425 X |
| 5,224,593 | 7/1993 | Bennett | 53/449 X |
| 5,269,216 | 12/1993 | Corominas | 53/425 X |

*Primary Examiner*—James F. Coan

[57] ABSTRACT

An apparatus for the sterilization and secondary packaging into cartons of arrays of blister packages, each of which contains at least one hydrophilic contact lens immersed in a sterile aqueous solution. More specifically, disclosed is an apparatus adapted to provide for the assembly of paired arrays of blister packages which are suitably interleaved and transported in batches of predetermined quantities within one or more trays. These trays are transported to a sterilization chamber for sterilizing the arrays of blister packages, and from which the sterilized arrays of blister packages in which at least the contents thereof are maintained in a sterile condition, and which are then transported to a locale for implementing the secondary packaging thereof into sealable cartons. Also disclosed is a method of sterilizing and thereafter implementing the secondary packaging into cartons of predetermined quantities of arrays of blister packages, each of which contains a hydrophilic contact lens immersed in a sterile aqueous solution, so as to provide a clean environment for the arrays of blister packages.

106 Claims, 25 Drawing Sheets

APPARATUS AND METHOD FOR STERILIZATION AND SECONDARY PACKAGING

BACKGROUND OF THE INVENTION

The present invention relates to an apparatus for the sterilization and secondary packaging into cartons of arrays of blister packages, each of which contains at least one hydrophilic contact lens immersed in a sterile aqueous solution. More specifically, the invention is directed to an apparatus adapted to provide for the assembly of paired arrays of blister packages which are suitably interleaved and transported in batches of predetermined quantities within one or more trays. These trays are transported to a sterilization chamber for sterilizing the exterior surfaces of the arrays of blister packages, particularly the lens-containing interiors thereof, and from which the sterilized arrays of blister packages are then transported to a locale for implementing the secondary packaging thereof into sealable cartons. In addition to the foregoing, the invention is also directed to a method of sterilizing and implementing the secondary packaging into cartons of predetermined quantities of arrays of blister packages, each of which contains a hydrophilic contact lens immersed in a sterile aqueous solution, so as to provide a sterile environment for the arrays of blister packages.

The packaging of hydrophilic contact lenses in a sterile aqueous solution is well known in the contact lens manufacturing technology. Particularly, packaging arrangements of that type generally consist of so-called blister packages adapted to be employed for the storage and dispensing of the hydrophilic contact lenses for use by a medical practitioner or a consumer who intends to wear the contact lenses. Such hydrophilic contact lenses, which may be disposable after a single period of wear or short-term use, are inexpensively manufactured from suitable hydrophilic polymeric materials; for example, copolymers of hydroxyethylene methacrylate (HEMA) containing from about 20% to 90% or more of water, depending upon the polymer composition. These contact lenses are generally stored immersed in a sterile aqueous solution, ordinarily consisting of an isotonic saline solution, in order to prevent dehydration and to maintain the lenses in a ready-to-wear condition.

A blister package of the foregoing type normally comprises a base member which is molded from a suitable injection-molded or thermoformed plastic material; for instance a polyolefin, such as polypropylene, and incorporates a cavity adapted to house the contact lens in the aqueous solution. The cavity is sealingly closed by a label-forming cover, preferably in the form of a flexible multi-layered laminated foil or suitable fill structure to provide the so-called blister package. This type of packaging arrangement has found widespread use in view of the inherently advantageous storing properties thereof and easy-to-dispense nature of the package by simply peeling the foil from the base member enabling a user to gain ready access to the contact lens which is contained in the cavity of the base member. For example, a blister package which is adapted to provide a sterile sealed storage environment for a disposable, essentially single-use hydrophilic contact lens, which is normally worn for about 8–18 hours within any 24-hour period, wherein the lens is immersed in a sterile aqueous solution within the package is described in U.S. Pat. No. 4,691,820 to Martinez; which is assigned to the common assignee of the present application, and the disclosure of which is incorporated herein by reference.

In the above-mentioned U.S. patent, the blister package for storing and dispensing a hydrophilic contact lens includes an injection-molded or thermoformed plastic base portion or member incorporating a molded cavity which is surrounded by an outstanding planar flange extending about the rim of the cavity. A flexible cover sheet, such as a laminated foil is adhered to the surface of the flange so as to sealingly enclose the cavity in a generally liquid-tight manner. The surface of the covering foil may constitute a label and be imparted suitable printing indicia informative of the product stored in the blister package, the name and address of the manufacturer, and also incorporate various decorative designs and logos as desired; and also provide for changeable information, such as lot numbers, fitting parameters, expiration dates and the like in addition to the foregoing, such as may be required by FDA regulations.

At this time, a novel and unique concept has been developed through a design for packaging arrangements of the blister package type, particularly for the containment of hydrophilic contact lenses in a sterile aqueous solution, wherein a plurality of base members for such blister packages, each having a cavity for containing a hydrophilic contact lens in the sterile aqueous solution, are adapted to be positioned in a contiguous array and sealing covered by a single or unitary flexible cover sheet, the latter of which is preferably in the form of a multi-layered flexible laminate web having a foil or silicon oxide layer therein. In this instance, the laminated cover sheet is provided with weakening lines, preferably in the form of perforations, extending intermediate each of the respective base members so as to enable individual segments of the foil member to be detached along the weakening lines and in conjunction with the therewith associated base member separated from the remaining array when it is desired to gain access to the contact lens contained in the separated blister package without adversely affecting the integrity of the packaging. This type of arrayed multiple interconnected blister package structure enables the compact packaging of a plurality of such arrays, each possessing a specified number of contact lens-containing base members interconnected by a single flexible cover sheet, within the confines of a suitable sealed container, such as a rigid paperboard carton. In the carton there may be compactly stored a plurality of interleaved pairs of and superimposed arrays of blister packages wherein; for example, each array consists of five interconnected blister packages with each of the latter having a single disposable contact lens housed therein. The carton may store six superimposed arrays of blister packages, for a total of thirty contact lenses; or in effect, a 30-day supply of contact lenses for respectively one eye of a user, although it is possible to contemplate to provide for cartons storing a 5-, 10-, 15-, 20-, or 25-day supply of contact lenses, or even other quantities. A packaging arrangement for contact lenses of that type which is in the form of arrays of interconnected blister packages is disclosed in applicant's copending U.S. patent application Ser. No. 08/257,796, entitled "Packaging Arrangement for Contact Lenses", which is commonly assigned to the assignee of the present application and the disclosure of which is incorporated herein by reference.

The blister packages which are formed through the intermediary of this structure comprise a plurality of contiguously arranged injection-molded base members each containing a cavity for housing a hydrophilic contact lens in a sterile aqueous solution, and wherein the resultant array of such base members; for example, five (5) base members, is adapted to be sealingly covered and interconnected by a single multi-layered flexible laminated foil or web which also forms a common label, preferably of the type disclosed in applicant's copending U.S. patent application Ser. No. 08/106,386, filed Aug. 13, 1993, entitled "Method of Double-Sided Printing of a Laminate and Product Obtained Thereby" assigned to the common assignee of the present application, and the disclosure of which is incorporated herein by reference.

In the foregoing disclosure, the multi-layered laminated foil includes an outer layer of a plastic film material, such as a polyolefin and preferably polyester, which is adhesively bonded to the surface of a supporting metallic foil, such as aluminum, although a layer of silicon oxide could be utilized instead of the metallic foil, and in which the outer layer is double-sided printed; in effect, on both opposite surfaces. The surface of the outer plastic film layer which faces towards and is adhered to the metallic foil is imprinted with suitable indicia and legends which may consist of permanent information regarding the manufacturer and the product, logos, instructive material, and decorative and advertising indicia relative the product in the blister package; whereas the opposite or exterior surface of the outer plastic film material layer may include suitable changeable information, such as expiration dates, lot numbers, fitting parameters, lens power, and other data specific to the packaged product. The interior surface of the outer plastic film material layer, when desired, may be imprinted. through the intermediary of suitable lithographic printing, either in single color or multicolors and also provided with an appropriate printed background; whereas the changeable information specific to the product which is imprinted on specific areas of the outwardly facing surface of the outer film layer, may be printed thereon through thermal transfer printing, as described in detail in the above-referenced copending U.S. patent application Ser. No. 08/106,386.

SUMMARY OF THE INVENTION

In order to accomplish the foregoing sterilization of the arrays of blister packages, particularly of the product or contact lens-containing interiors thereof, and to thereafter implement their secondary packaging into sealable cartons, the inventive apparatus contemplates the utilization of a novel conveyor system in which the foregoing is achieved in an essentially automated mode of operation. Specifically, the apparatus provides for the conveyance of a plurality of trays, each adapted to house therein a specific quantity of interleaved pairs of arrays of blister packages, such as are disclosed in the copending U.S. patent application Ser. No. 08/257,796 which are sequentially folded into paired interleaved positions, and then conveyed through the intermediary of a transfer conveyor into a respective tray so as to fill spaces in the latter arranged in specified rows and columns. The tray, which is placed into an upended position in order to be able to receive the interleaved pairs of arrays of blister packages from a shuttle conveyor, upon being filled is then tilted back into a normally horizontal orientation and, if desired depending upon production requirements, a plurality of such array-filled trays may then be vertically stacked or superimposed, and also conveyed in a series of such stacked trays. A conveyor is adapted to convey the trays with the arrays of blister packages contained therein into a sterilization chamber, such as an autoclave, in which the arrays of blister packages are collectively sterilized. Subsequent to the sterilization procedure having been completed, the trays together with the sterilized arrays of blister packages are transported by a further conveyor towards an unloading arrangement in which the trays are unstacked and individual trays then sequentially upended. This enables the contents of the trays to be transferred to an unloading shuttle conveyor which, in turn, facilitates specified quantities of interleaved pairs of arrays of blister packages to be advanced in succession into a cartoner having open-ended cartons therein adapted to receive the arrays of blister packages. Thereupon, each of the filled cartons is closed and sealed in the cartoner and transported to further stations for suitable additional handling, such as weighing, labeling and possible assembling for boxing and warehousing, as may be required. The emptied trays are then repositioned or tilted into their horizontal orientations and conveyed in series to a return conveyor so as to be in conditions of readiness for refilling with arrays of blister packages which are to be sterilized, as referred to hereinabove.

Accordingly, it is an object of the present invention to provide an apparatus for the sterilizing and secondary packaging of specified quantities of arrays of blister packages, with each package containing a contact lens immersed in a sterile aqueous solution.

A more specific object of the present invention is to provide an apparatus of the type described in which a procedure for filling trays with specified quantities of the arrays of blister packages is implemented in an automated manner, the trays transported to a sterilizing chamber, and thereafter transported to an unloading arrangement for discharging the arrays of blister packages with their sterilized contents from the trays and effectuating packaging thereof into sealable cartons.

Still another object of the present invention is to provide an apparatus of the type described in which there are carried out the functions of orienting the arrays of blister packages, positioning the arrays for filling into suitable trays, transporting and stacking the trays prior to conveyance thereof into the sterilizing chamber, transporting the trays with the sterilized arrays of blister packages to an arrangement in which individual of the trays are unstacked, advanced to an unloading station, and the arrays of sterilized blister packages are conveyed to a cartoner for filling cartons with the packages.

Yet another object of the present invention is to provide a method of sterilizing and secondary packaging into cartons of arrays of blister packages, each containing a contact lens immersed in a sterile aqueous solution through utilizing of the apparatus as described herein.

A more specific object of the invention is to provide a method for the sterilization and secondary packaging into cartons of a plurality of arrays of blister packages in which the method is implemented through the utilization of automated conveyor and sterilization apparatus in a highly efficient and precise mode of operation.

BRIEF DESCRIPTION OF THE DRAWINGS

Reference may now be had to a preferred embodiment of the apparatus for sterilization and secondary packaging constructed pursuant to the invention, particularly as directed to the packaging of contact lenses in a sterile environment, taken in conjunction with the accompanying drawings; in which.

DETAILED DESCRIPTION

Figure 1:
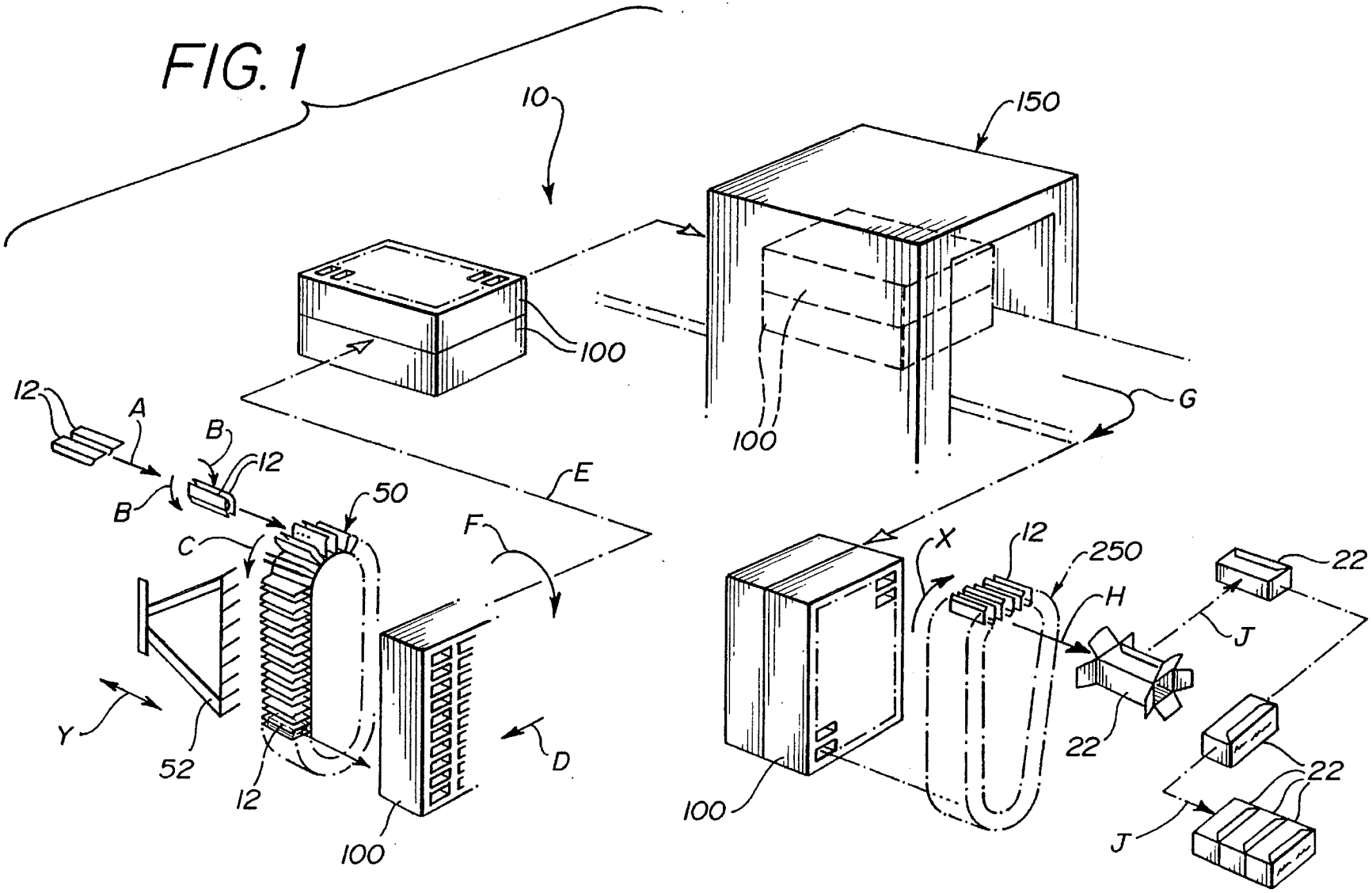
FIG. 1 is a schematic perspective view of an apparatus for the sterilization and secondary packaging of arrays of interconnected blister packages for the sterilized containment of contact lenses.

Referring now in more specific particularity to the drawings, as shown in FIG. 1, there is disclosed a perspective schematic representation of the overall operating structure of an apparatus 10 for implementing the sterilization and secondary packaging into cartons of pluralities of superimposed paired arrays of blister packages utilized for the containment of contact lenses in a sterile environment.

FIG. 1 illustrates the infeed of the blister package arrays 12 along the direction of arrow A so as to be placed in paired interleaved relationship by a product pick-up and rotating device (not shown) as in arrows B, the further conveyance of the interleaved arrays 12 in sequential order so as to be positioned in spaces present between outwardly extending fingers of an endless loop-type tray loading shuttle conveyor assembly 50 which is indexed forwardly in the direction of arrow C until all of the spaces along a vertical run thereof are filled with paired interleaved arrays 12, whereupon the conveyor assembly is adapted to be temporarily brought to a standstill, and a suitable pusher 52 transfers a vertical stack of the arrays 12 from the conveyor into a vertical column or row of array-receiving spaces in an upended tray 100. The tray 100 is intermittently indexed in the direction of arrow D until all of the vertical rows of spaces therein are filled with interleaved pairs of arrays 12 of blister packages.

As further illustrated in FIG. 1, the array-filled tray 100 is shown as being conveyed along the direction of arrow E, while being prior thereto rotated in the direction of arrow F into a horizontal position, and may be stacked with other similarly filled trays 100 in order to be thusly conveyed into a sterilization chamber 150, which may be an autoclave. From the sterilization chamber 150, the stacks of trays 100 with the arrays of blister packages 12 contained therein, with at least the contents such as the contact lenses in the blister packages remaining in a sterile condition, are then conveyed along the direction of the arrow G, and the trays unstacked and individually advanced and upended in succession. The upended tray 100 is positioned in alignment with an unloading shuttle conveyor assembly 250 to enable a pusher member to sequentially engage into vertical rows of spaces of the tray 100 housing the arrays of blister packages and transfer the latter into spaces present between outwardly extending fingers on a loop-type endless conveyor of assembly 250. The conveyor is indexed forwardly in the direction of the arrow H, and a pusher element slides a succession of a plurality of sterilized arrays of blister packages into the open end of a carton which has been brought into alignment therewith by means of a cartoner. The filled cartons are then closed and sealed and conveyed along arrow J to suitable locations for further handling.

Figure 2:
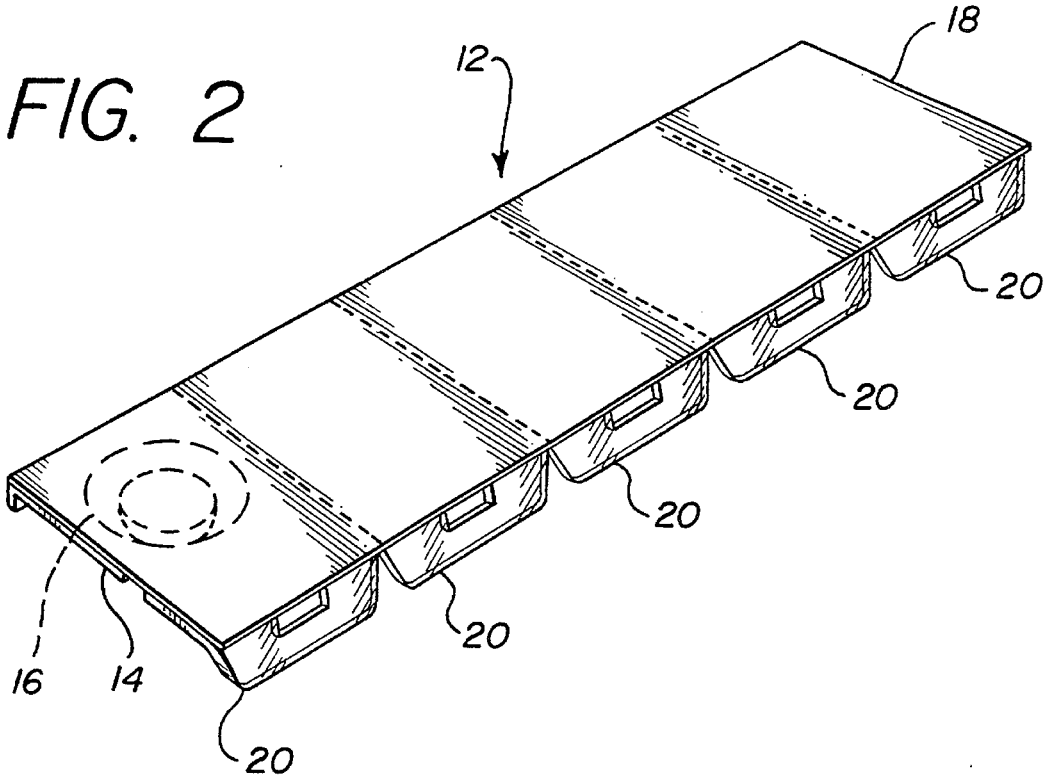
FIG. 2 is a perspective view of a typical array of interconnected blister packages.

As shown in FIG. 2 of the drawings, each array of blister packages 12 consists of five adjacently located base members 14 each possessing a cavity 16 for the containment of a contact lens immersed in a sterile aqueous solution, and with the array 12 being sealingly covered by a single printed label-forming flexible laminated cover sheet 18, so as to be separable along perforation lines into individual blister packages, each respectively containing a single contact lens.

Figure 3:
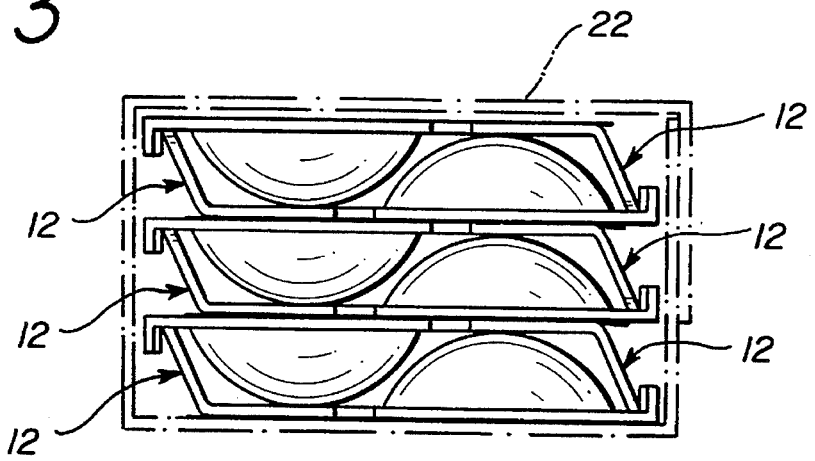
FIG. 3 is side elevational view of a plurality of interleaved paired and superimposed arrays of interconnected blister packages, showing the intended orientation there n a carton.
Figure 4:
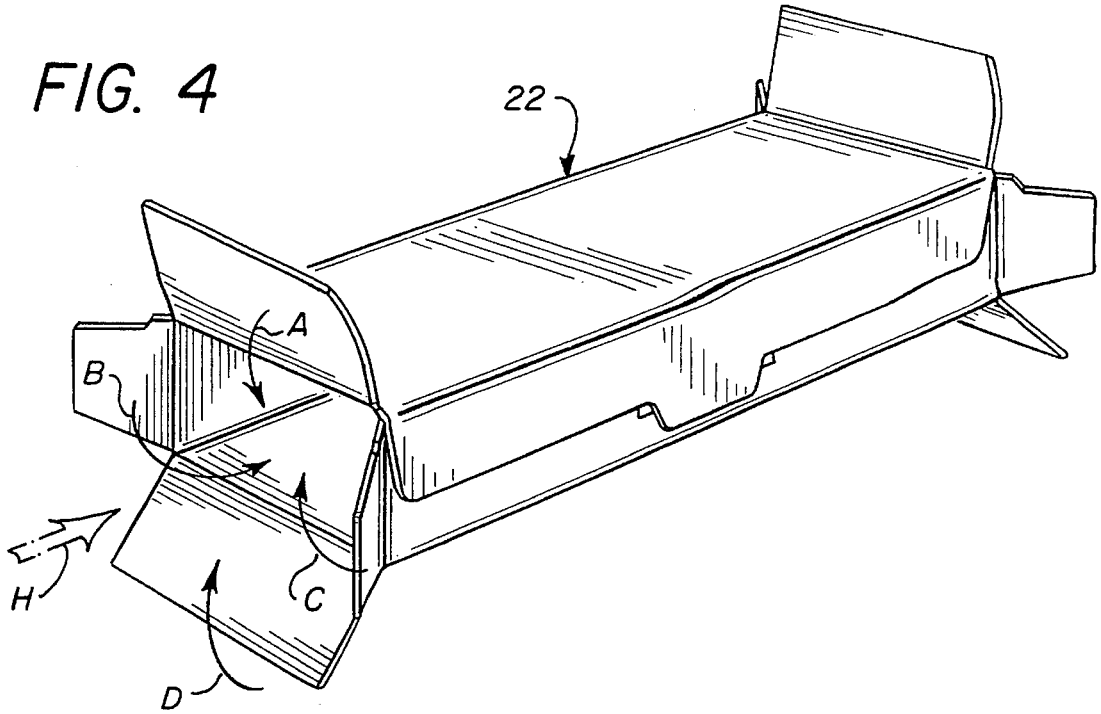
FIG. 4 is a perspective view of a partially assembled carton, shown with the end flaps in an opened condition adapted for the receipt of the plurality of arrays of blister packages of FIG. 3.
Figure 5:
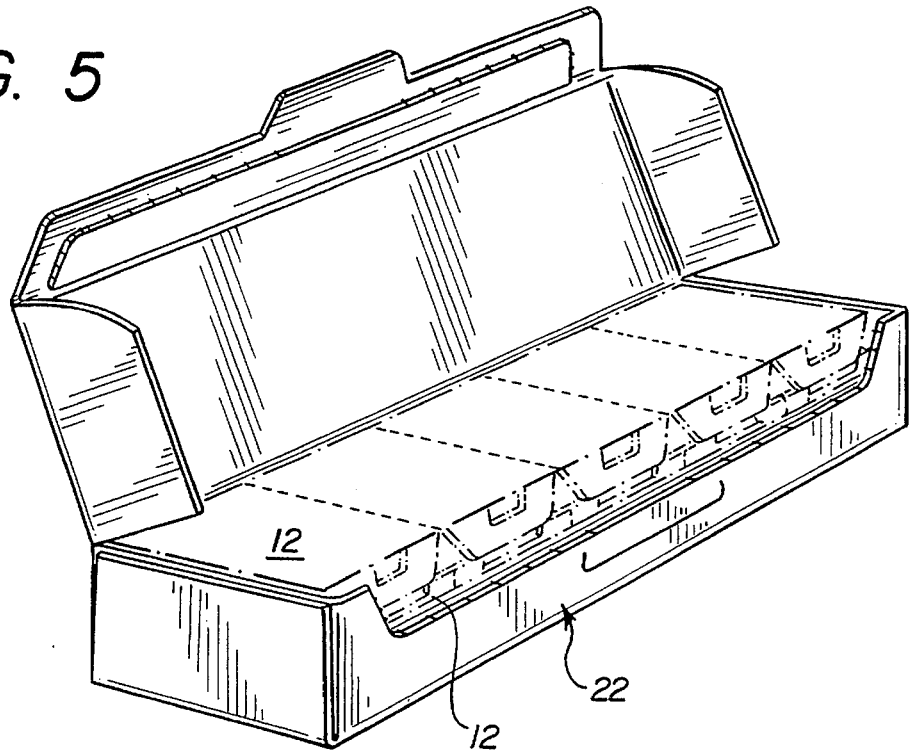
FIG. 5 is a perspective view of a carton containing arrays of blister packages, shown with the cover having been opened to enable access by a user to the contents of the carton.

The base members 14, each of which possesses a flange 20 at one end thereof, are constructed as disclosed in copending U.S. patent application Ser. No. 08/257,796 when positioned in a carton 22 as illustrated in FIG. 3 arranged in inverted interleaved pairs of arrays 12, shown in the drawing as consisting essentially of six arrays in this particular instance, filling a carton 22 as shown in FIG. 4 in the direction of the arrow H, whereby the end flaps of the carton are adapted to be closed in sequence A–D to form the carton of FIG. 5. The latter is illustrated with the opening of the reclosable top flap thereof to enable access to the individual blister packages 12 therein by medical practitioner or user of the contact lenses.

Figure 6:
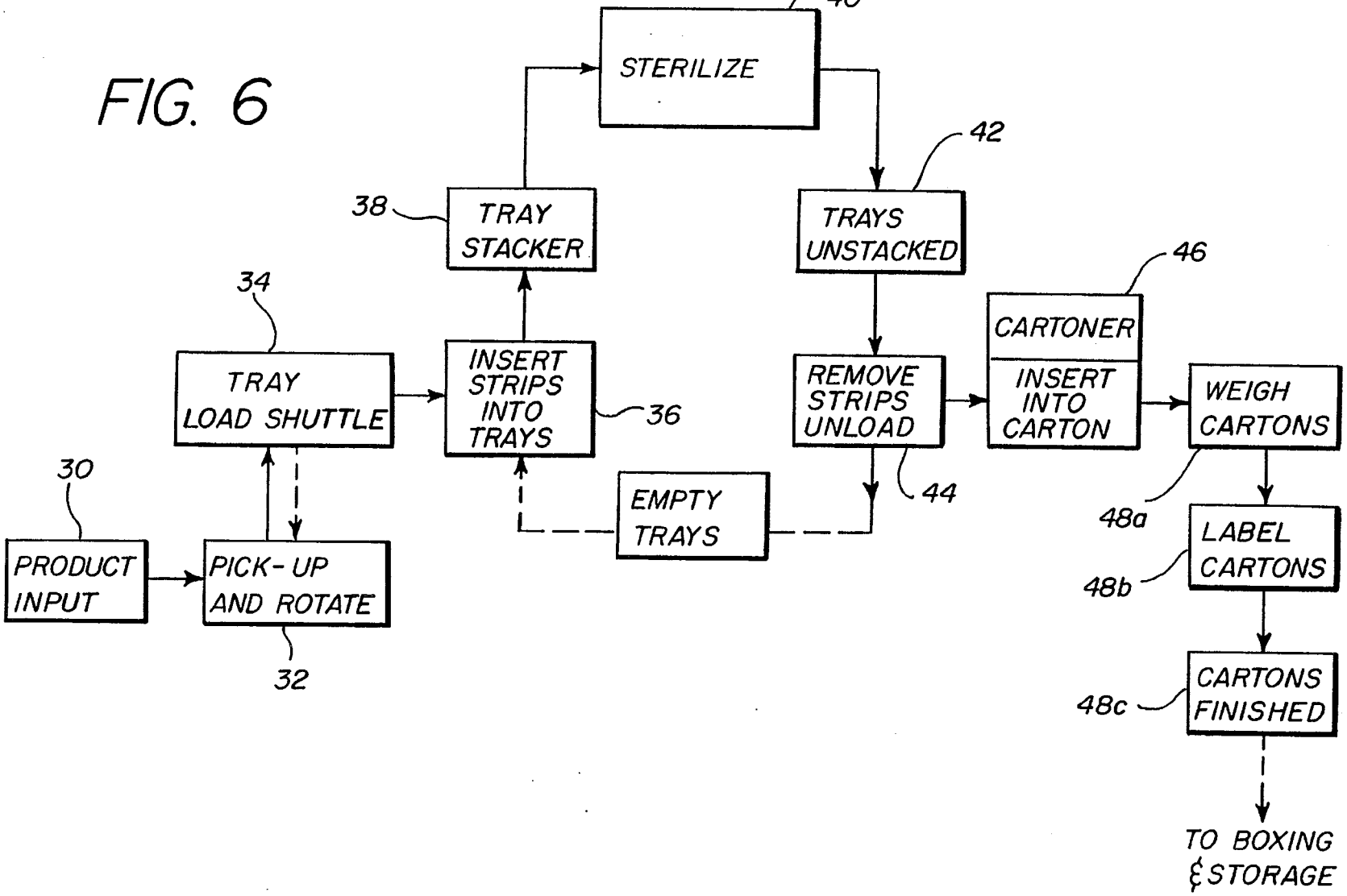
FIG. 6 is a flow chart illustrative of the sequence of operation of the apparatus shown in FIG. 1.

Referring to FIG. 6 of the drawings illustrating a flow chart of the cycle of operation for the apparatus 10 for the sterilization and secondary packaging into cartons of the arrays of blister packages 12, at a first station 30 for the product input this provides for arrays of blister packages 12 in a side-by-side position to be folded and interleaved in a pick-up and rotating device 32, from there through the intermediary of a suitable pusher to be transferred into a position 34 for a shuttle conveyor assembly. The assembly of the conveyor is filled with the interleaved pairs of arrays of blister packages by a pusher as the shuttle conveyor belt is indexed forwardly, and upon being filled with a specified quantity of interleaved pairs of arrays of blister packages, a further pusher, while the conveyor 34 is in a standstill mode, causes a vertical row of interleaved arrays of blister packages to be transferred into a vertical row of spaces in an upended tray position 36 which is positioned aligned adjacent thereto. At that point, upon the tray being indexed and filled, the latter is tilted into a horizontal and advanced to a tray stacking position 38 at which tray stackers are adapted to stack the filled trays and advance these to a sterilization chamber at position 40. Thereafter, the stacked trays are advanced to a tray unstacking station 42, from which individual unstacked trays are forwarded to a station 44 for sequentially removing the sterilized arrays of blister packages from the trays upon upending the trays and causing a pusher to transfer a vertical stack of the paired interleaved arrays of blister packages into an unloading endless loop-type shuttle belt conveyor at position 44. From the latter position 44, a specified number of pairs of arrays of blister packages are advanced into a cartoner at 46 in which open-ended cartons as shown in FIG. 4 are successively positioned in alignment therewith so as to be able to fill the cartons with specified numbers of pairs of arrays 12, essentially in a filling condition as shown in FIG. 3. The blister package array-filled cartons are then advanced to further stations **48*a*, 48*b* and 48*c*** for weighing, labelling, carton finishing and forwarding to a suitable collecting location for boxing and further handling.

The empty trays 100 are then conveyed to a location proximate the station 36 for inserting the interleaved pairs of arrays of blister packages into the trays and so as to be able to repeat the cycle of operation of the apparatus 10.

Figure 7:
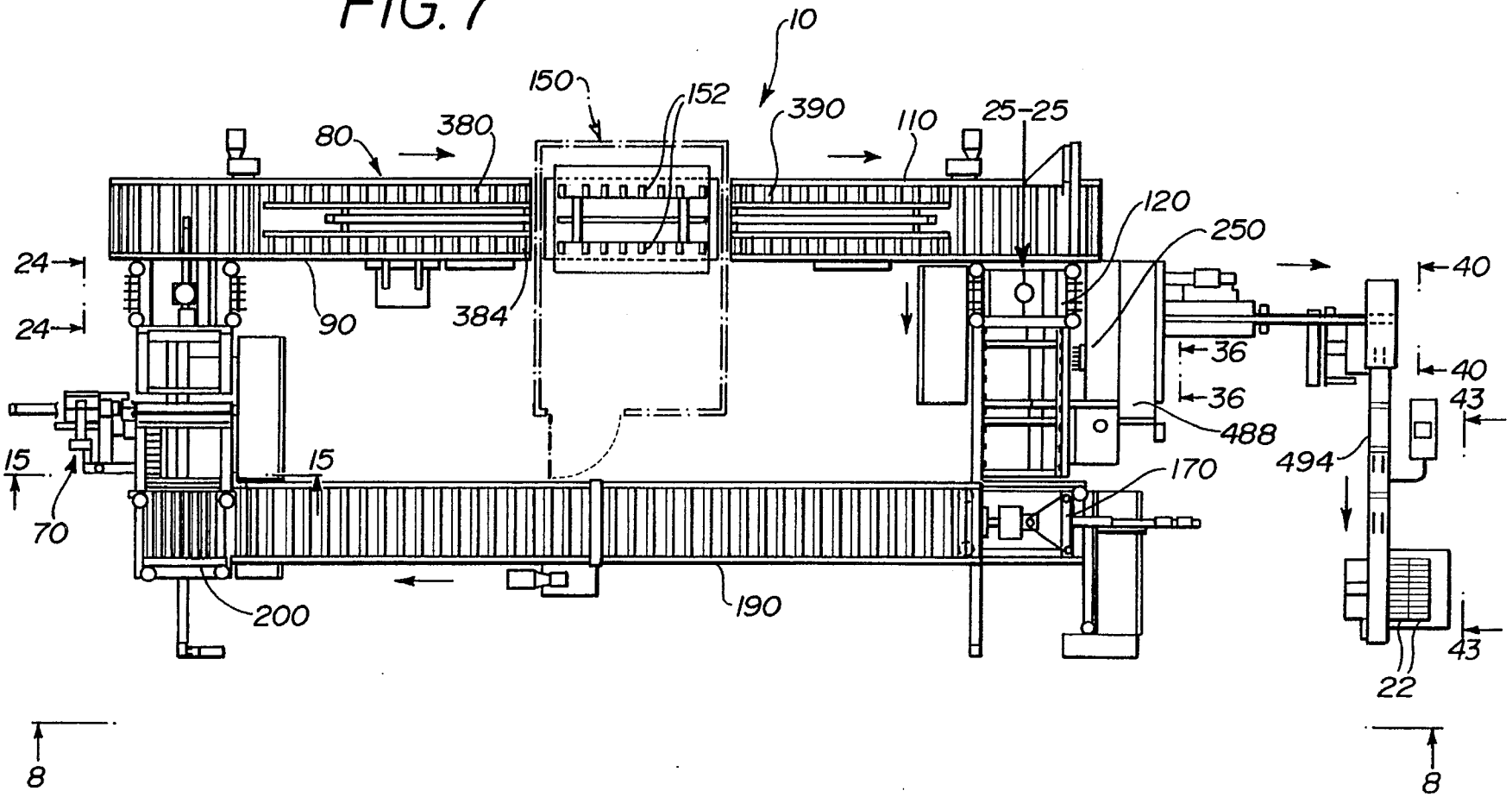
FIG. 7 is a top plan view of the overall layout of the apparatus.
Figure 8:
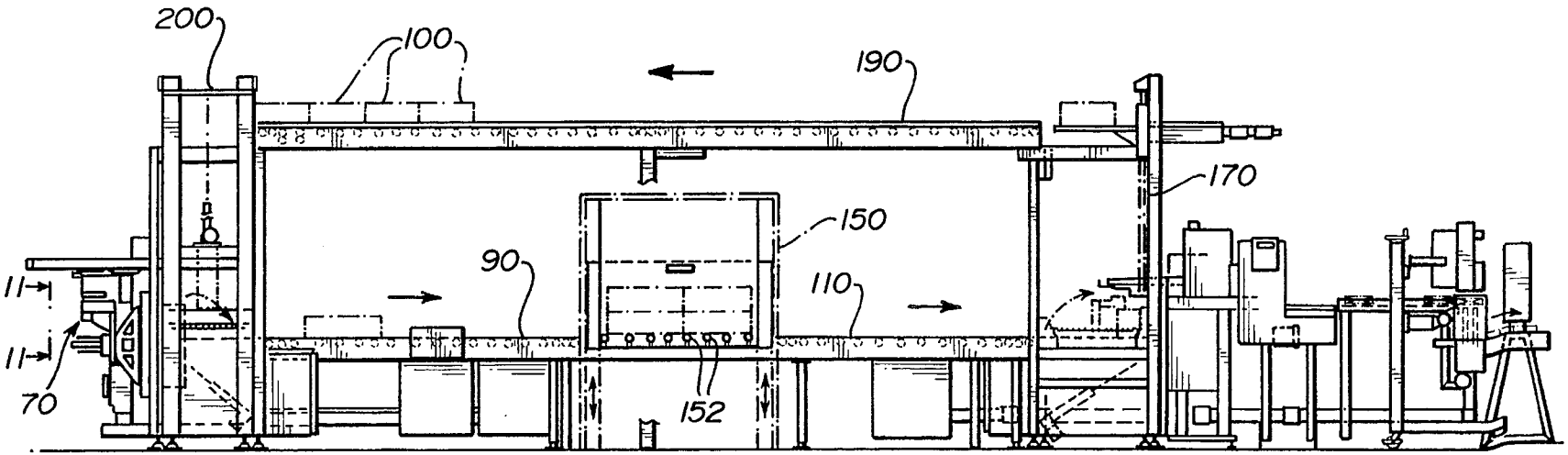
FIG. 8 is an elevational view in the direction of line 8—8 in FIG. 7.

Shown in FIG. 7 is the apparatus 10 for implementing the specific cycle of operation. An overall layout in FIGS. 7 and 8 of the drawings, illustrates respectively top plan and elevational views of the apparatus 10.

Referring specifically to FIG. 7 of the drawings, an arrangement for advancing an empty tray 100 and upending the empty tray at the shuttle conveyor assembly 50 is identified by reference numeral 360.

A product input station is disclosed herein and identified by reference numeral 70, at which the arrays 12 are placed into position for being subsequently loaded into the upended empty tray 100. A structure for advancing and stacking trays 100 is disclosed and generally identified by reference numeral 80, from which stacked trays 100 which have been previously filled with interleaved pairs of arrays 12 are advanced on a roller conveyor 90 leading to the sterilization chamber 150 which is adapted to receive and sterilize a specified number of stacked and series of blister package array-filled trays 100. A further roller conveyor generally identified by reference numeral 110 leads to a tray unstacker structure 120 from which individual and unstacked trays 100 are advanced to the array unloading shuttle conveyor assembly 250 while previously being upended so as to be positioned in alignment with the unloading shuttle conveyor assembly. The latter is then adapted to receive a stack of paired interleaved arrays of blister packages and indexed upwardly so as to advance predetermined interleaved pairs of arrays into a succession of open-ended cartons as shown in cartoner 200. The filled cartons are then conducted in succession towards the various stations **48*a*, 48*b* and 48*c* as identified in FIG. 6, while the emptied trays 100 are again tilted into their initial horizontal positions and hoisted by means of a tray lifting mechanism 170 upwardly onto a roller conveyor 190 for return to the starting location 200, with the empty trays being maintained in series on the roller conveyor 190**.

Figure 9:
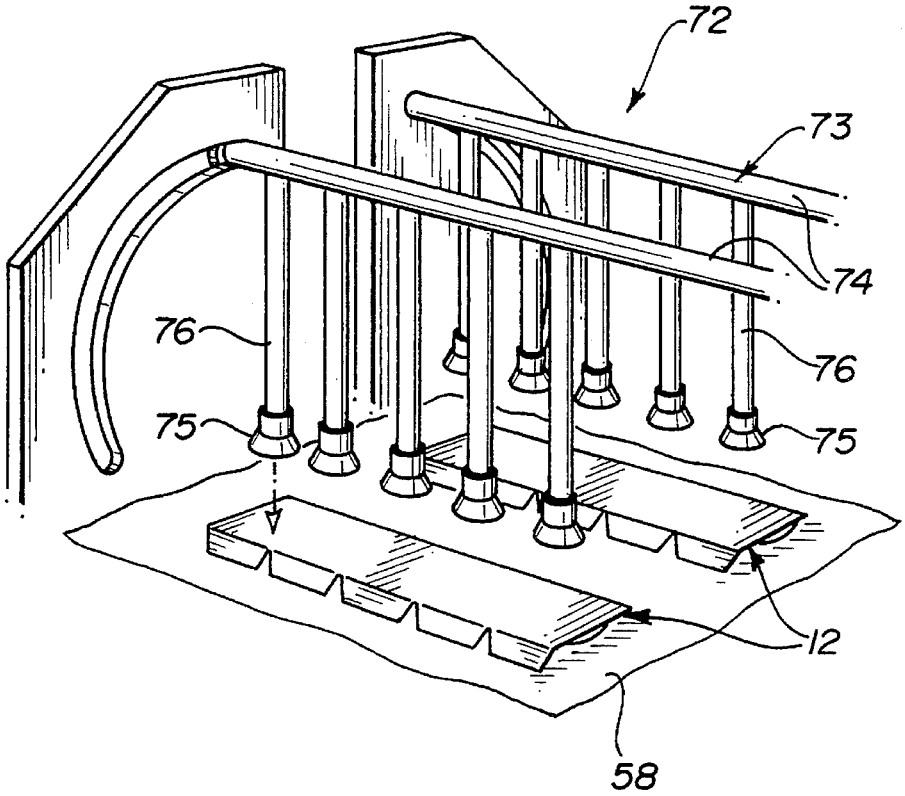
FIG. 9 is a schematic perspective view of a blister package array pick-up and rotating device in a first operative condition thereof.
Figure 10:
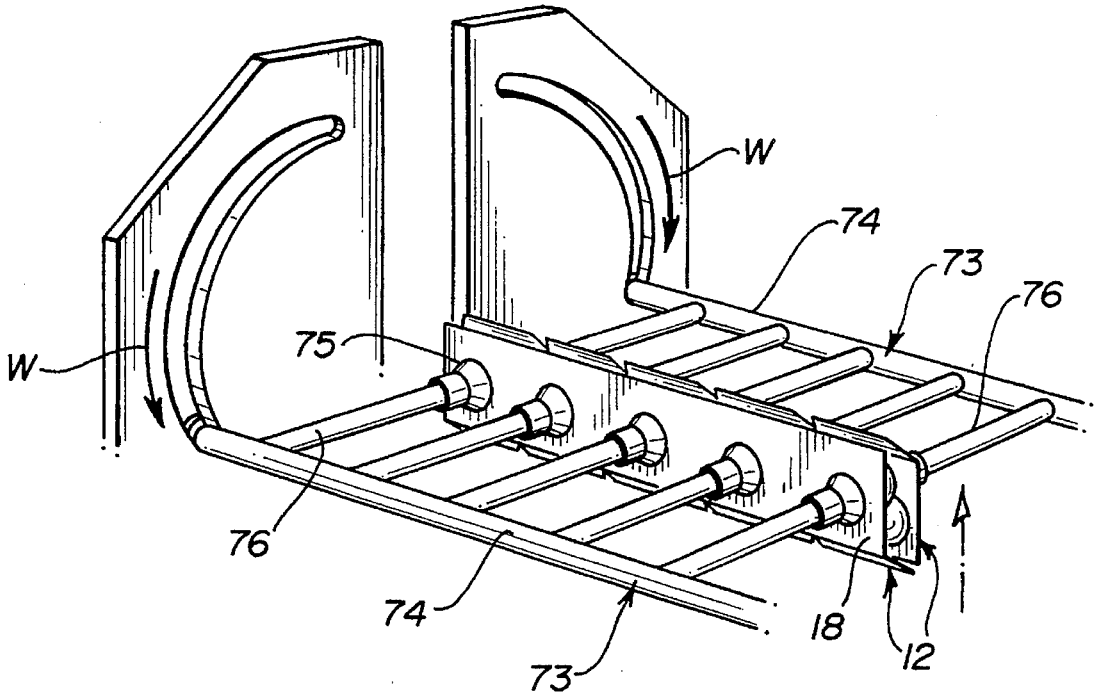
FIG. 10 is a view similar to FIG. 9, showing the device in another operative condition.
Figure 11:
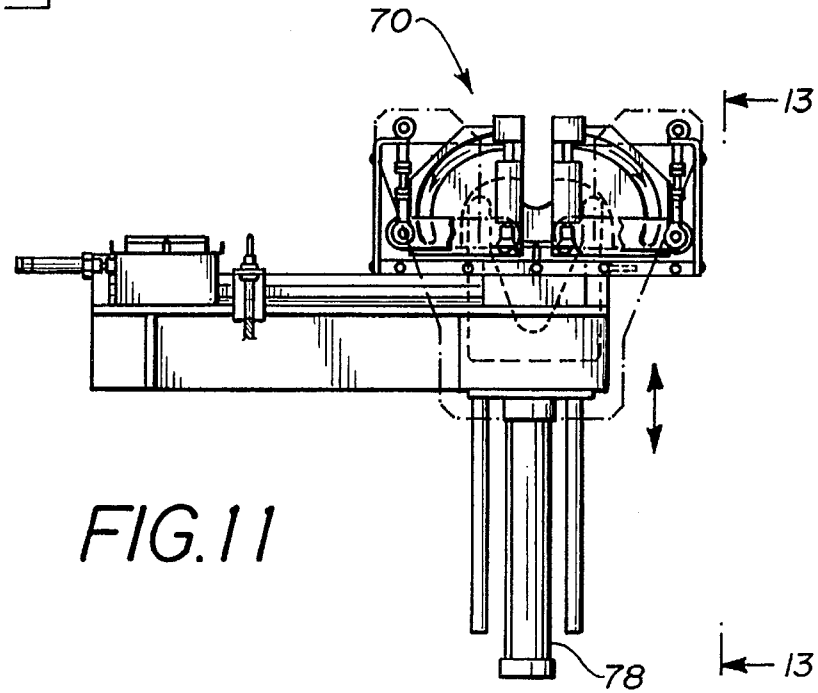
FIG. 11 is an elevational detail view of the device of FIG. 9, shown in the direction of line 11—11 in FIG. 8.
Figure 12:
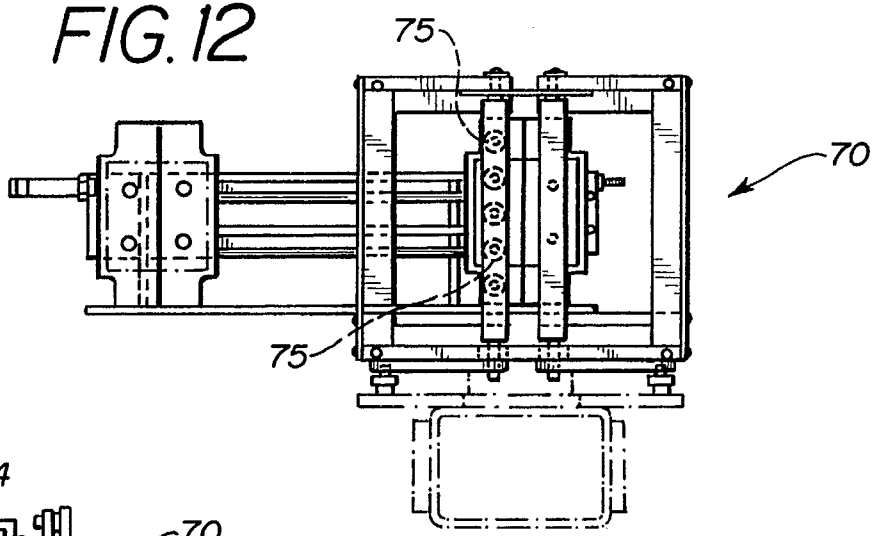
FIG. 12 is a top plan view of the device of FIG. 11.
Figure 13:
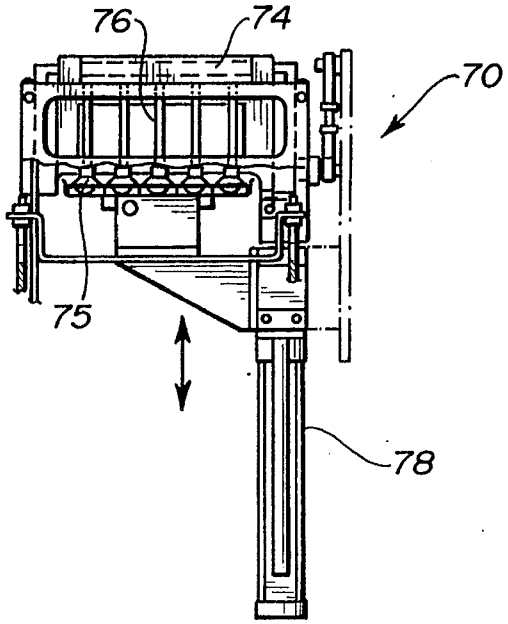
FIG. 13 is a side elevational view of the device of FIG. 11.

As shown in FIGS. 9 through 13 of the drawings, as also in FIG. 9, a pair of arrays of blister packages 12 are in side-by-side position placed on a support surface 58 of pick-up and rotating device 32 beneath a vacuum pick-up arrangement 72 consisting of a pair of vacuum conduits 74 each having a plurality of suction elements 76 extending therefrom. FIG. 10 illustrates the elements 76 having engaged the cover surfaces 18 on the respective arrays of blister packages 12 and, as shown in FIGS. 10 and 11, being pivoted in an opposite arcuate mode in the direction of the arrows W so as to position the two arrays of blister packages 12 in a folded or facing interleaved position, essentially as these would ultimately be in when placed in a carton as shown in FIG. 3 of the drawings, wherein three of such interleaved arrays 12 are illustrated.

The station 32 which includes blister package array pick-up and rotating device 70 illustrated herein includes a central element 78 moving in an upward and downward motion so as to impart the arcuate displacement to the vacuum device for interleaving the respective paired arrays of blister packages, and in which a pair of manifolds 73 which are connected to a source of vacuum air (not shown) have suction cups 75 arranged at the lower ends of elements 76.

Figure 17:
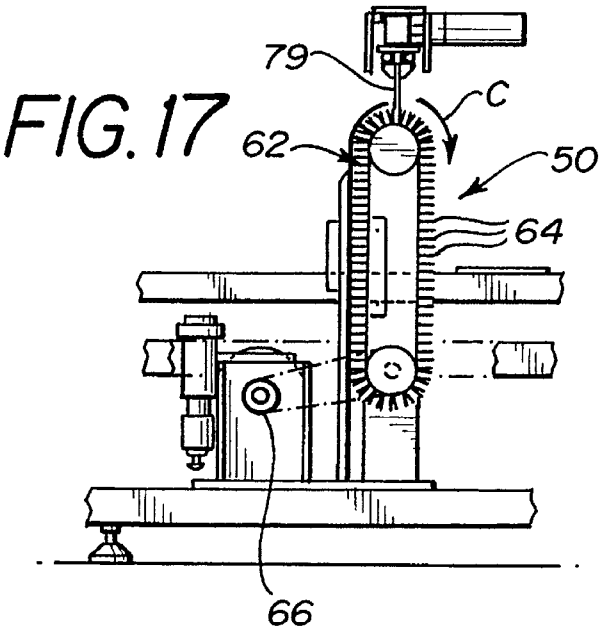
FIG. 17 is a side elevational view of the tray loading shuttle conveyor arrangement.
Figure 16:
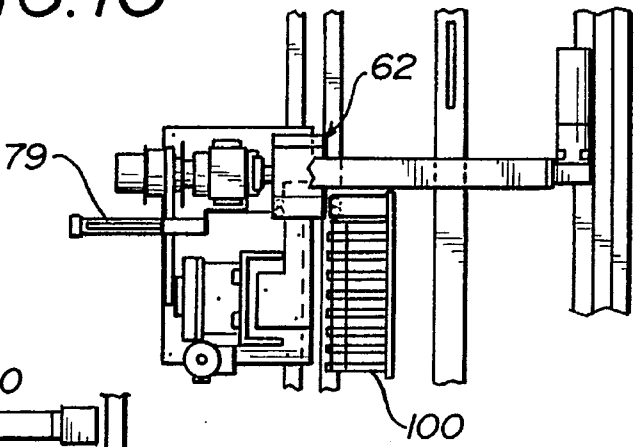
FIG. 16 is a top plan view of the tray loading shuttle conveyer arrangement.
Figure 15:
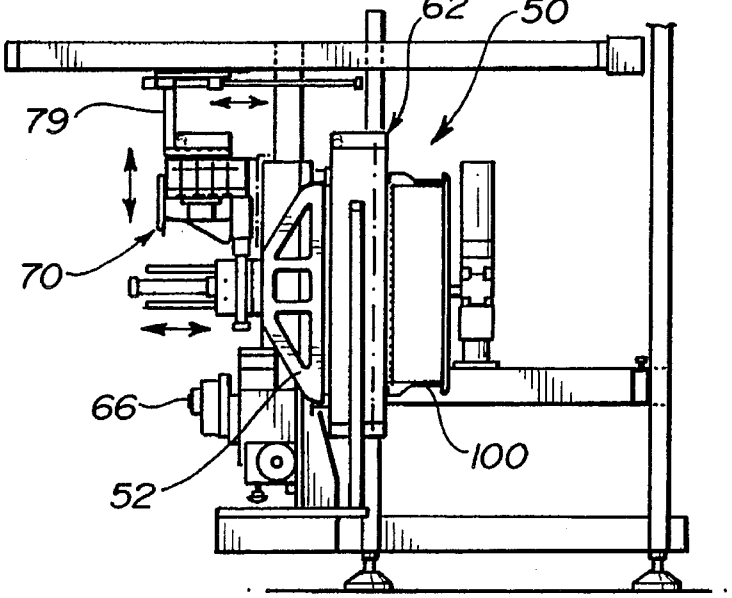
FIG. 15 is an elevational view of the tray loading shuttle conveyor arrangement, shown in the direction of line 15—15 in FIG. 7.

As pairs of interleaved arrays of blister packages 12 are placed into the position as shown in FIGS. 15 through 17, they are adapted to be advanced into a tray loading shuttle conveyor assembly 50 for subsequent loading into a tray 100.

Figure 14:
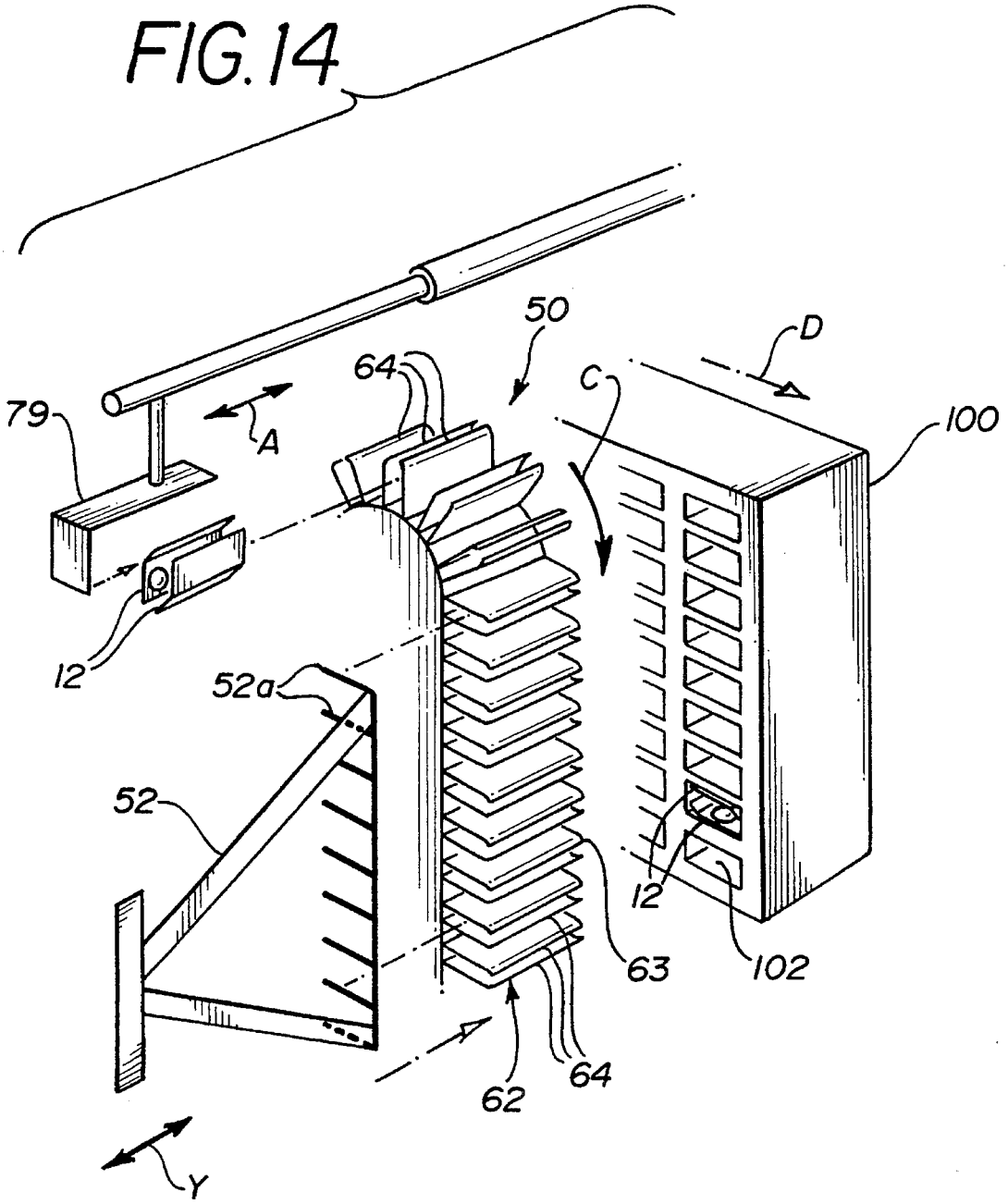
FIG. 14 is a schematic perspective view showing the transfer of interleaved paired arrays of blister packages from the pick-up and rotating device into a tray through the intermediary of a tray loading shuttle conveyor arrangement.

As schematically illustrated in FIG. 14 in which the array pick-up and rotating device 70 is represented, a pusher element 79 which is described in further detail hereinbelow with respect to FIGS. 18A through 18D of the drawings, advances the interleaved pair of arrays of blister packages into the interspaces between a series of radially outwardly paddle-shaped extending fingers or support surfaces 64 on an endless loop-type transport conveyor 62, the latter of which is described in more specific detail with regard to FIG. 15 through 17 of the drawings.

As shown in FIG. 14, the endless conveyor belt 62 of tray loading shuttle conveyor assembly 50 is adapted to be indexed in the direction of the arrow C shown in FIG. 1 so as to enable the pusher element 79 to respectively advance an interleaved pair of blister packages 12 into each interspace between successively radially extending fingers or support elements 74 on the endless belt conveyor 72. The conveyor belt 72, as shown in FIG. 17 of the drawings, is adapted to be rotated in the direction of the arrow C through the intermediary of a suitable drive unit and pulley system 66 which will provide for the specified indexing rotational movement of the former in synchronism with the introduction and subsequent discharge of the arrays of blister packages therefrom.

The upended tray 100 which is positioned in proximity to a vertical run 63 of the loading conveyor belt 62, and which includes vertical rows of spaces 102 of a number analogous to the number of spaces between the fingers 64 on the vertical run of the loading conveyor belt 62, is adapted to be indexed in the direction of the arrow D shown in FIG. 1 so as to align in successive order with vertical rows of spaces 102 in the tray 100 the spaces in the vertical run 63 of the loading conveyor belt 62 which has been filled with the interleaved pairs of arrays of blister packages.

Figure 18A:
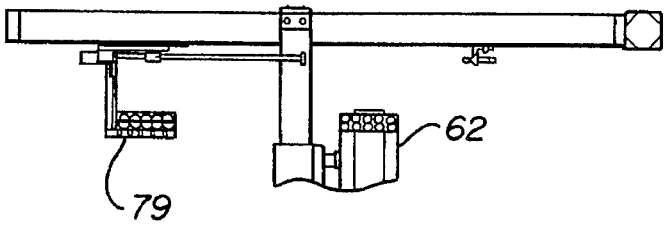
FIGS. 18A through 18D are views of the sequence in the transfer of an interleaved pair of arrays of blister packages from the pick-up and rotating device into tray loading shuttle conveyor arrangement.
Figure 18B:
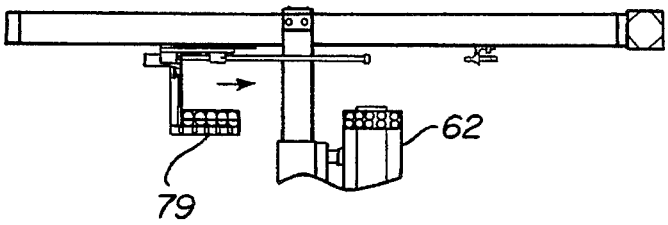
Figure 18C:
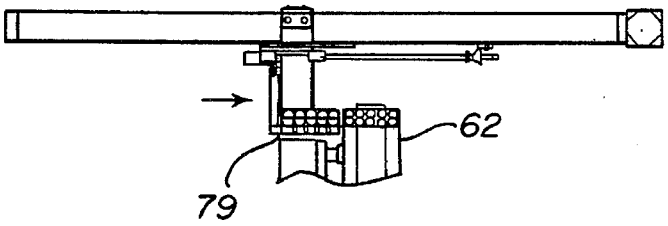
Figure 18D:
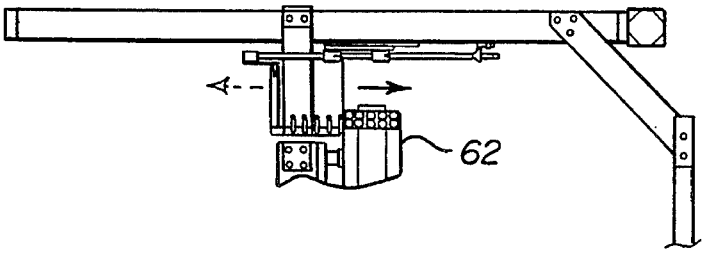

The pusher element 79 for sliding the interleaved pairs of arrays of blister packages into the interspaces between the radially outwardly extending paddle-like finger elements 64 on the loading conveyor belt 62 are illustrated in FIGS. 18A through 18B of the drawings, whereby successive interleaved pairs of arrays 12 are caused to be advanced in the direction of the arrow A under the urging of the pusher element so as to transfer these interleaved pairs of arrays 12 from the pickup and rotating device 70 into the interspaces between adjacent fingers 64 of the conveyor belt 62, as shown in FIG. 14.

Upon the interspaces along the vertical run 63 of the conveyor belt 62 having been filled with interleaved pairs of arrays of blister packages 12 analogous in number with the vertical row of spaces 102 in the tray 100 which is positioned upended adjacent thereto, a pusher member 52, as also illustrated in FIGS. 14 and 15, which contains a number of comb-like fingers 52*a* commensurate in number with the spaces in the vertical run 63 of the endless conveyor belt 62 and the vertical row of spaces 102 in the upended tray 100 is advanced in the direction of the arrow shown in FIG. 1 so as to be able to simultaneously fill the vertical row of empty spaces 102 in the tray 100 each with an interleaved pairs of arrays of blister packages 12 by rushing the latter from the conveyor belt 62 into the tray 100.

Figure 19:
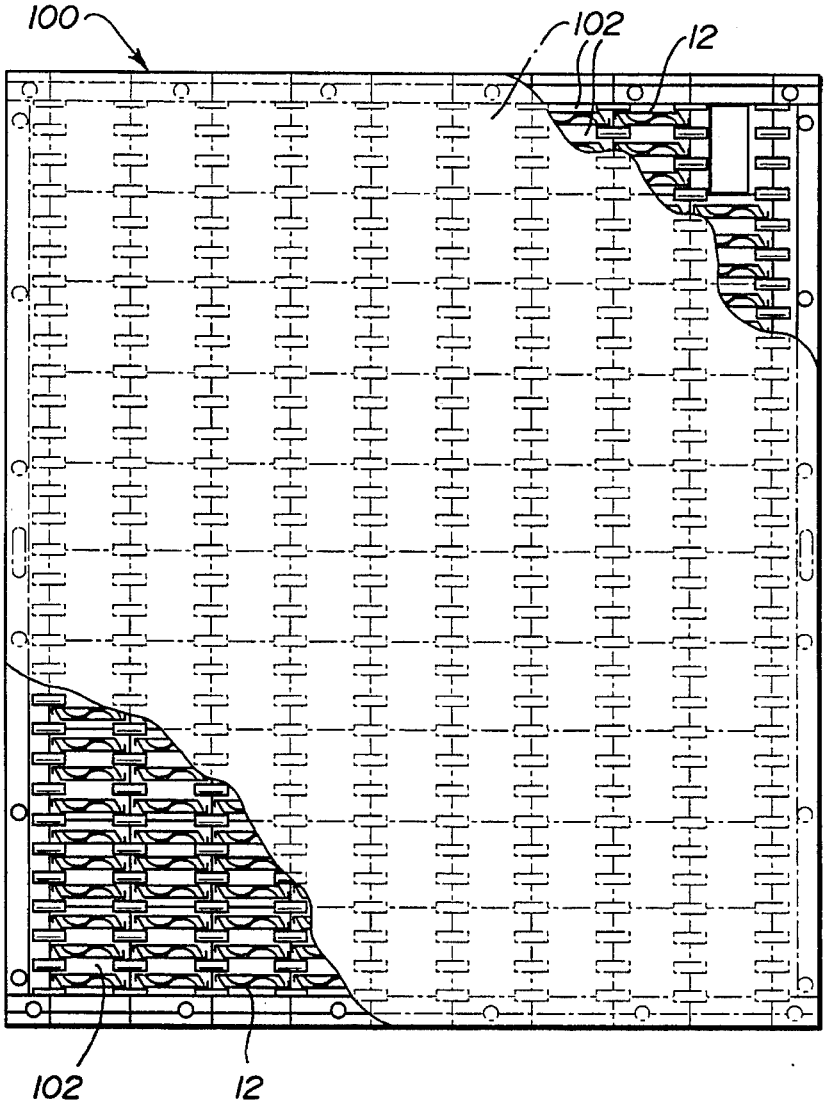
FIG. 19 is an elevational view of a tray shown in an upended position.
Figure 20:
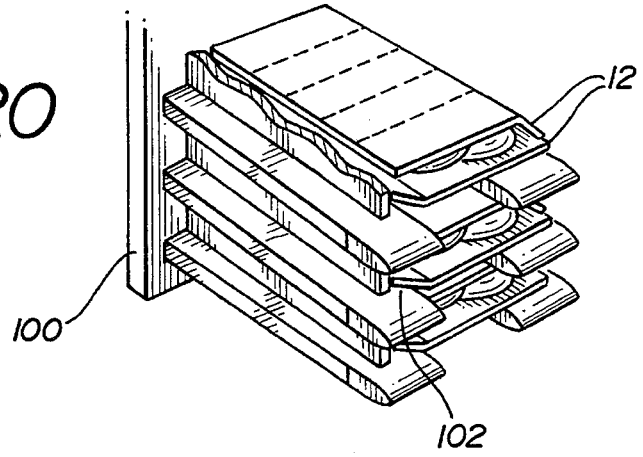
FIG. 20 is a fragmentary perspective view of the tray of FIG. 19 showing the positioning of interleaved pairs of blister package arrays therein.

The comb-like pusher member 52 is thereafter retracted along the double-headed arrow Y and filling of the vertical run of the loading conveyor again effected by the pusher element 79 sequentially ejecting interleaved arrays from the pick-up and rotating arrangement 70, while the tray 100 is indexed forwardly along the direction of the arrow D to enable filling of successive vertical rows of spaces 102 until the tray is completely filled with arrays 12. As shown in FIGS. 19 and 20 of the drawings, the spaces 102 in each vertical row of the tray 100 are filled with respectively a pair of interleaved arrays of blister packages, and supported therein as shown in FIG. 20 in a mode similar to that in the interleaved pairs of trays will be ultimately packaged in a carton 22.

Figure 23:
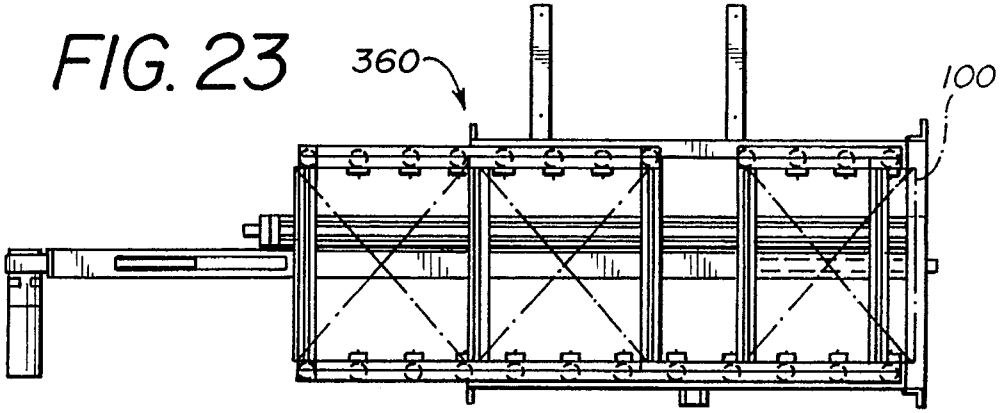
FIG. 23 is a top plan view of the tray tilting assembly.
Figure 22:
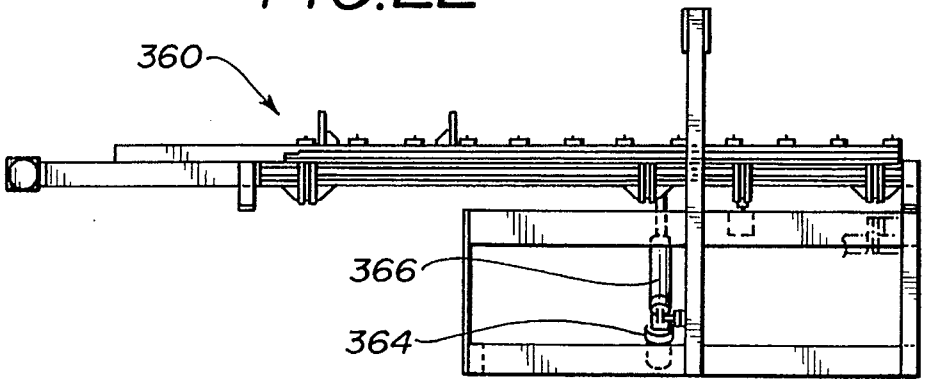
FIG. 22 is a side elevational view of the tray tilting assembly.
Figure 21:
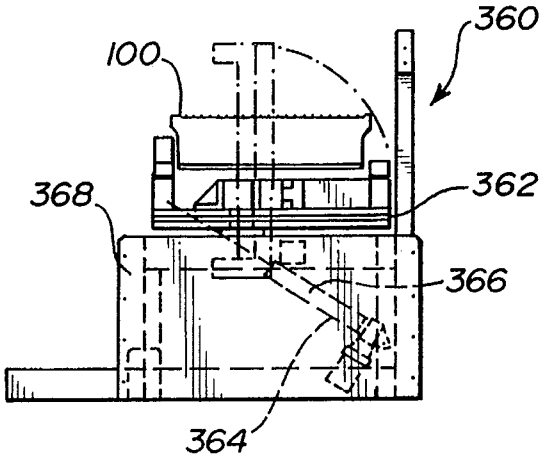
FIG. 21 is an elevational view of a tray tilting assembly.

Shown in FIGS. 21 and 23 of the drawings is the installation 360 for upending empty trays 100 prior to positioning thereof at the location adjacent the loading shuttle conveyor assembly 50 for filling the trays 100 with the interleaved pairs of arrays of blister packages 12.

As shown, particularly in the drawing of FIG. 21, a tray 100 which is normally oriented in a horizontal or lay flat condition when in readiness for use thereof while located on the tray returning conveyor 400 of the apparatus 10, is conveyed to a platform 362, which includes a tilting mechanism 364. The mechanism is adapted through the intermediary of gripping arms and beams 366, 368 to tilt the tray 100 into an upright condition as shown by the arrow in FIG. 21, so as to have the upright tray align the vertical rows of spaces 102 therein to face the endless conveyor belt 62 as shown in FIGS. 14 through 17 of the drawings.

Figure 24:
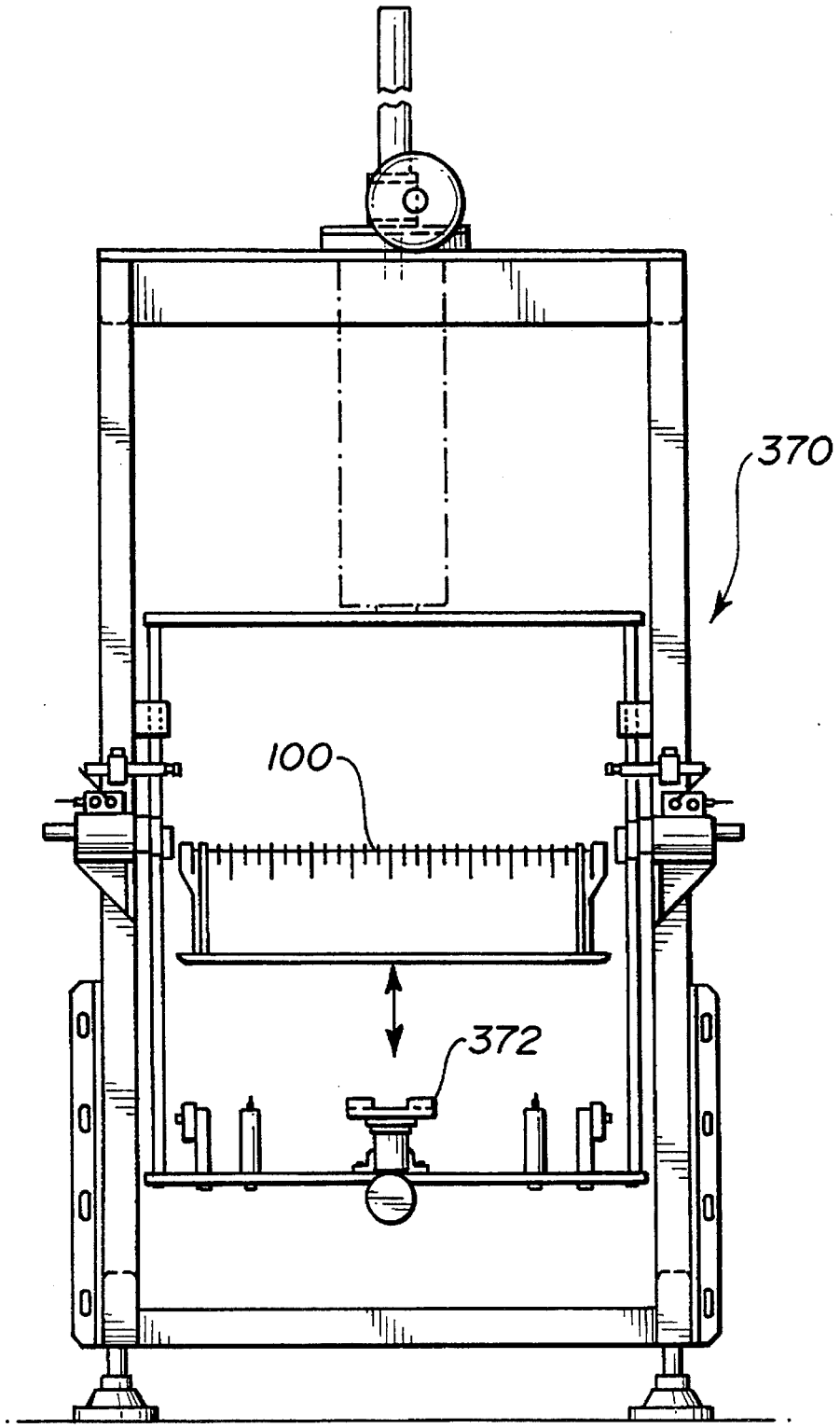
FIG. 24 is an elevational view of a tray upstacker assembly as seen in the direction of line 24— 24 in FIG. 7.
Figure 25:
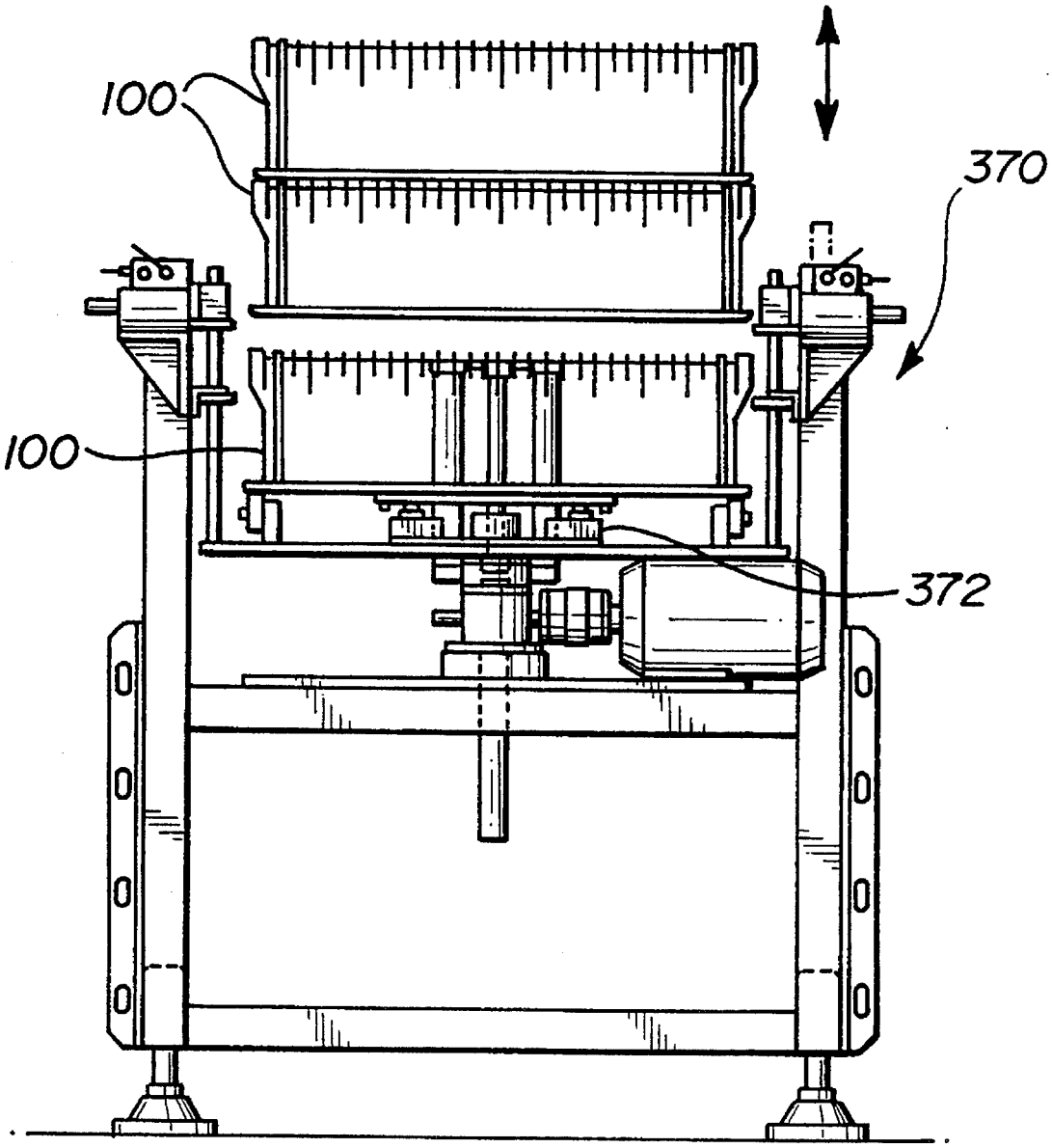
FIG. 25 is an elevational view of a tray downstacker assembly as seen in the direction of line 25—25 in FIG. 7.
Figure 28:
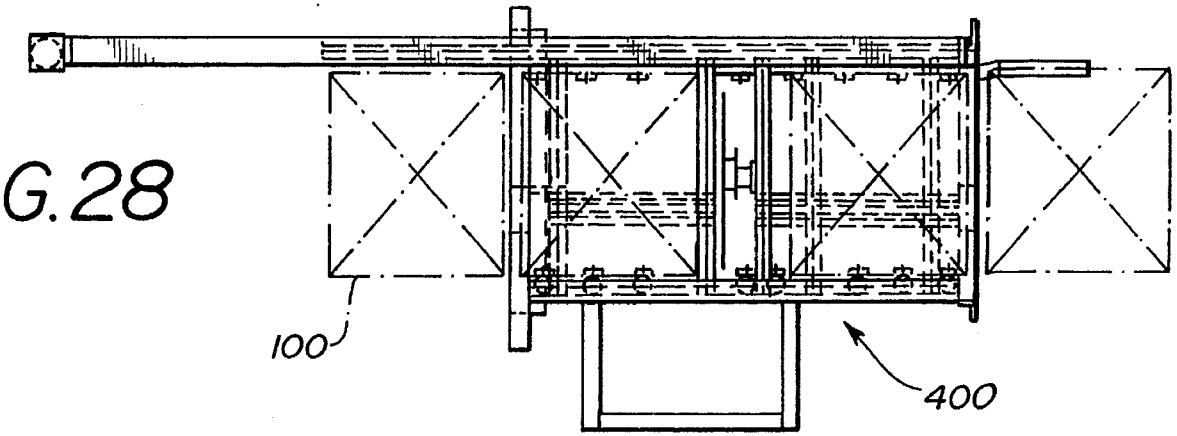
FIG. 28 is a top plan view of the tray unloading shuttle assembly.
Figure 27:
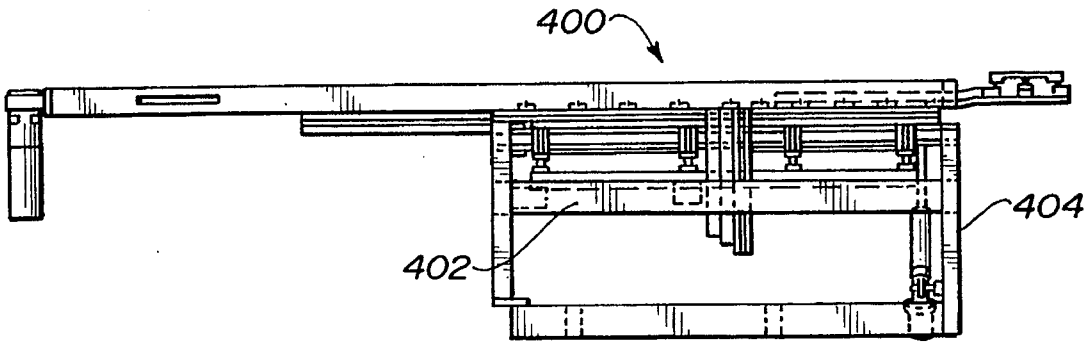
FIG. 27 is a side elevational view of the tray unloading shuttle assembly.

Each tray 100, upon having been fully filled with interleaved pairs of blister package arrays 12, is then adapted to be rotated into its horizontal position by the mechanism 364 of installation 360, as shown in FIG. 21, and adapted to be stacked with other similar filled trays, as illustrated in FIGS. 24 and 25 of the drawings. At the tray stacking location 38, the first tray 100 which has been filled with the blister package arrays is lowered by means of a vertical actuating mechanism 370 until coming to rest on a support 372, and subsequently following filled trays 100 are then moved into position superimposed thereon, as shown in FIG. 25. Although FIG. 25 illustrates three such filled trays being superimposed in stacked relationship, the apparatus 10 may also be operated with only a single series of trays, or alternatively, two or three trays 100 may be arranged in a stacked relationship. Upon the required number of trays having been stacked, the trays are then conveyed from mechanism 370 on a roller conveyor 380 by being pushed thereon by means of a suitable pusher or driven roller portion, and then in a direction along roller conveyor portion 384 including a tray gripping structure 386 into sterilization chamber 150, where the trays may be positioned supported on suitable rollers 152. The sterilization chamber 150, which may be an autoclave, may be designed to hold up to six trays 100 in two stacks of three superimposed trays each.

A further roller conveyor 390, subsequent to implementing the sterilization of the product, in effect the arrays of blister packages contained in each of the trays, conveys the trays 100 from the sterilization chamber 150 to tray unstacking station 42.

Figure 31:
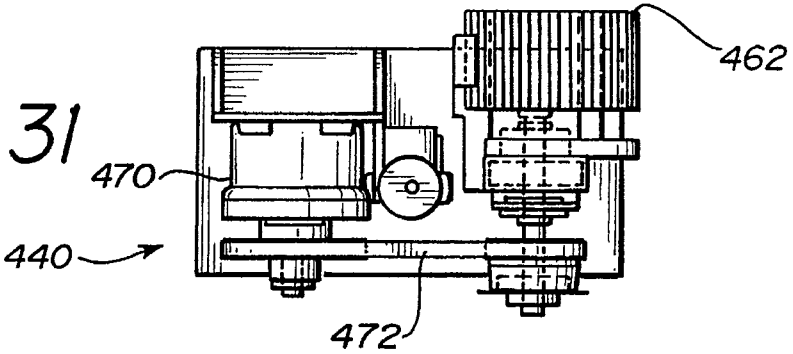
FIG. 31 is a top plan view of the tray unloading conveyor sub-assembly.
Figure 30:
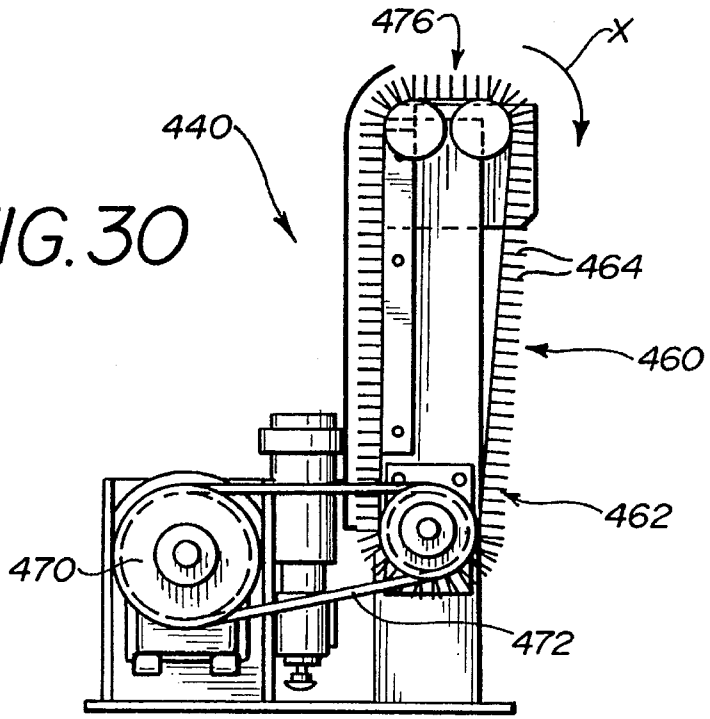
FIG. 30 is a side elevational view of the tray unloading conveyor sub-assembly.
Figure 29:
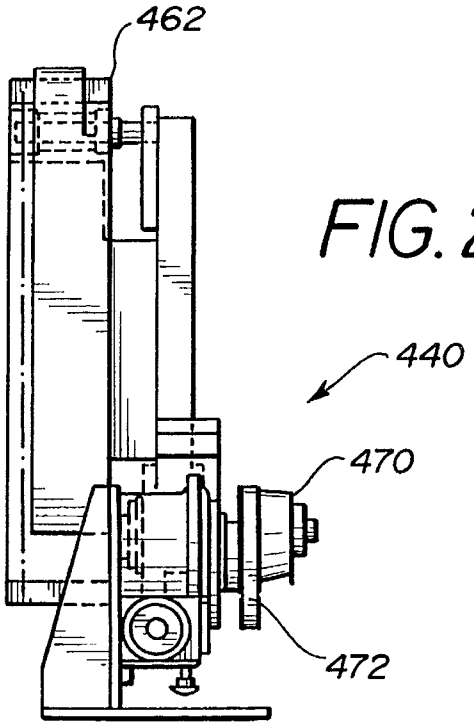
FIG. 29 is an elevational view of a tray unloading conveyor sub-assembly.
Figure 34:
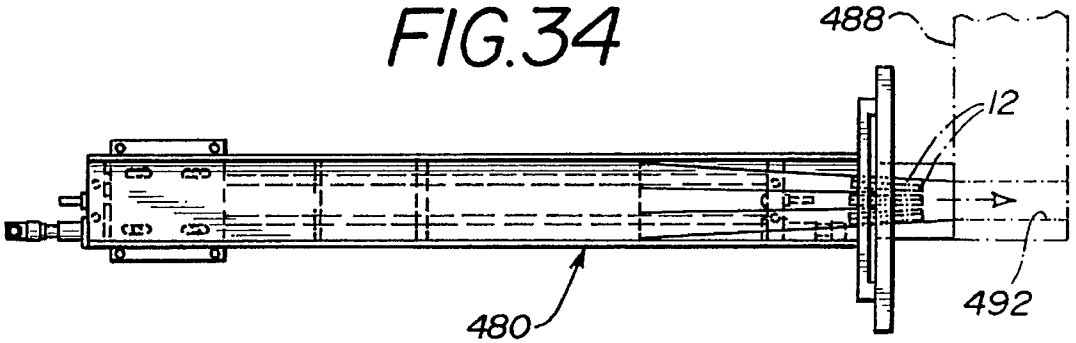
FIG. 34 is a top plan view of the carton loading arrangement.
Figure 33:
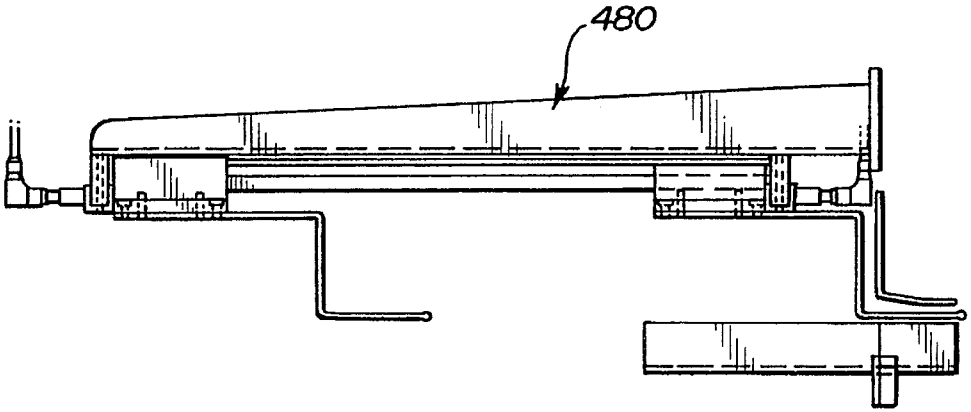
FIG. 33 is a side elevational view of the carton loading arrangement.
Figure 32:
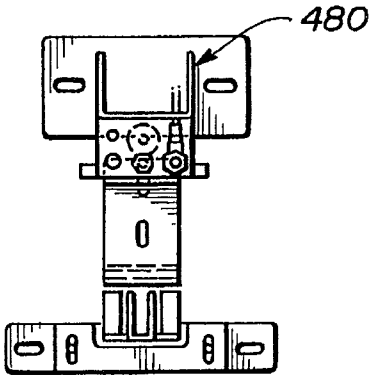
FIG. 32 is an elevational view of a carton loading arrangement.

At the tray downstacking station, a tray downstacker arrangement 400, as illustrated in FIGS. 25 through 28 of the drawings, maintains the upper trays 100 of each stack in an elevated position while enabling the lowermost tray 100 to be displaced downwardly along supports 402 on a framework 404 of the apparatus 10, and to contact a roller mechanism for conveyance towards a tray unloading shuttle conveyor assembly 440 at station 44. At this location, the trays 100 having been advanced by the downstacker, are individually and sequentially upended so as to face an unloading shuttle conveyor belt arrangement 460 which is constructed somewhat similar to that of the endless conveyor belt 62 of the tray loading shuttle conveyor assembly 50. As illustrated in FIGS. 29 through 31 of the drawings, the tray unloading assembly 440 includes vertically extending endless loop belt conveyor 462 having radially outwardly extending paddle-like fingers 464, the interspaces of which are adapted to receive interleaved pairs of sterilized arrays of blister packages 12.

The unloading shuttle conveyor arrangement 440 is operated in a predetermined indexing movement in the direction of the arrow X through the intermediary of a drive unit 470 and belt drive conveyor 472 operatively connected therewith. The upper end of the unloading belt conveyor 462 is entrained over a pair of guide rollers so as to provide for a horizontal flat run 476 for the interleaved pairs of blister package arrays 12.

Figure 26:
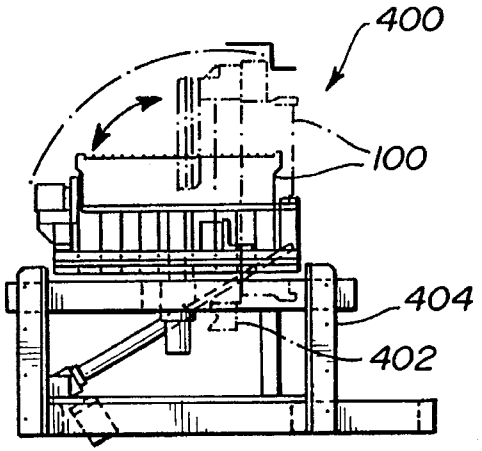
FIG. 26 is an elevational view of a tray unloading shuttle assembly.

As the tray 100 shown in FIG. 26 is upended so as to assume a vertical position, subsequent to having been unstacked from the other filled trays, the latter of which are maintained in a position of readiness by the downstacker arrangement 400, the upended tray 100 has a vertical row of its spaces 102 filled with sterilized interleaved pairs of blister package arrays located in alignment with a vertical run of the unloading conveyor belt 462 and a pusher element 466 which has a comb-like finger structure 466*a* similar to the pusher member 52 described with regard to the loading conveyor assembly 50, pushes a stack or vertical row of interleaved pairs of arrays 12 from the row of spaces 102 in the upended tray 100 into the interspaces between adjacent fingers 464 on the conveyor belt 462.

Figure 35:
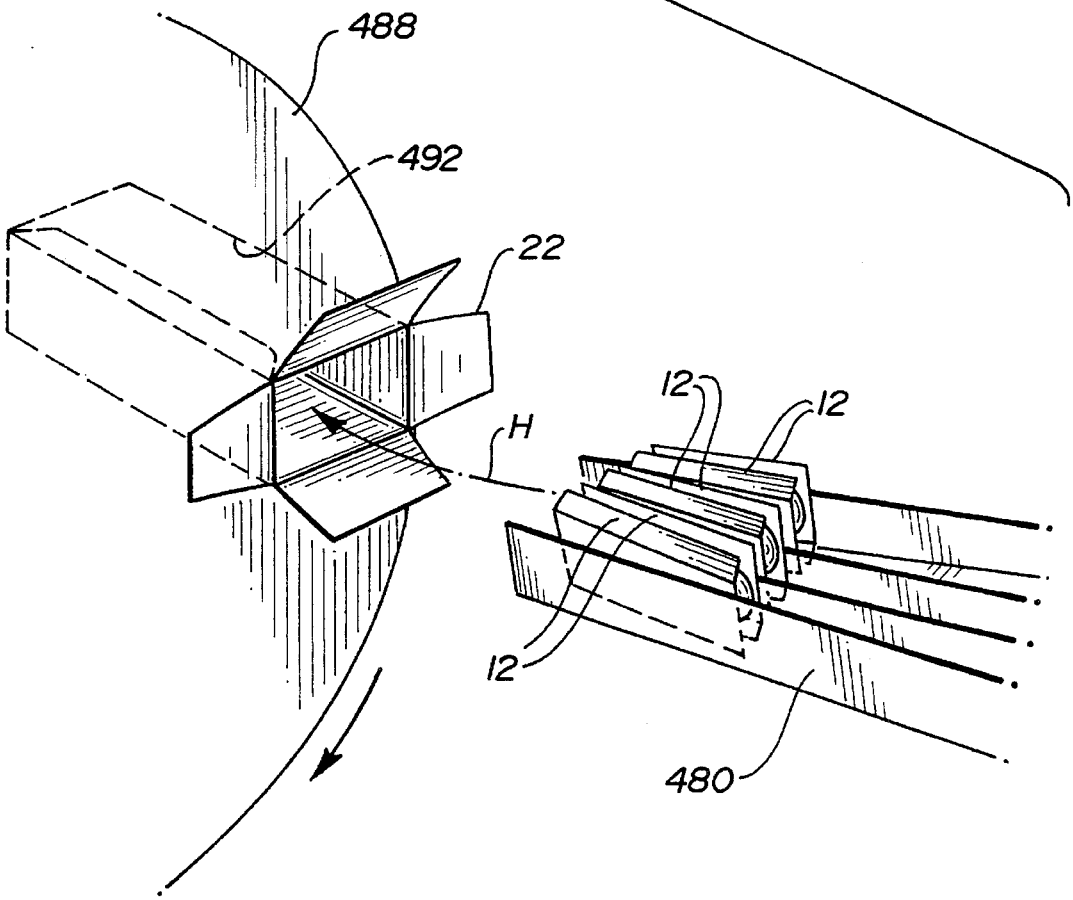
FIG. 35 is a perspective schematic view illustrating the loading of a plurality of interleaved pairs of blister packages into a carton.
Figure 36:
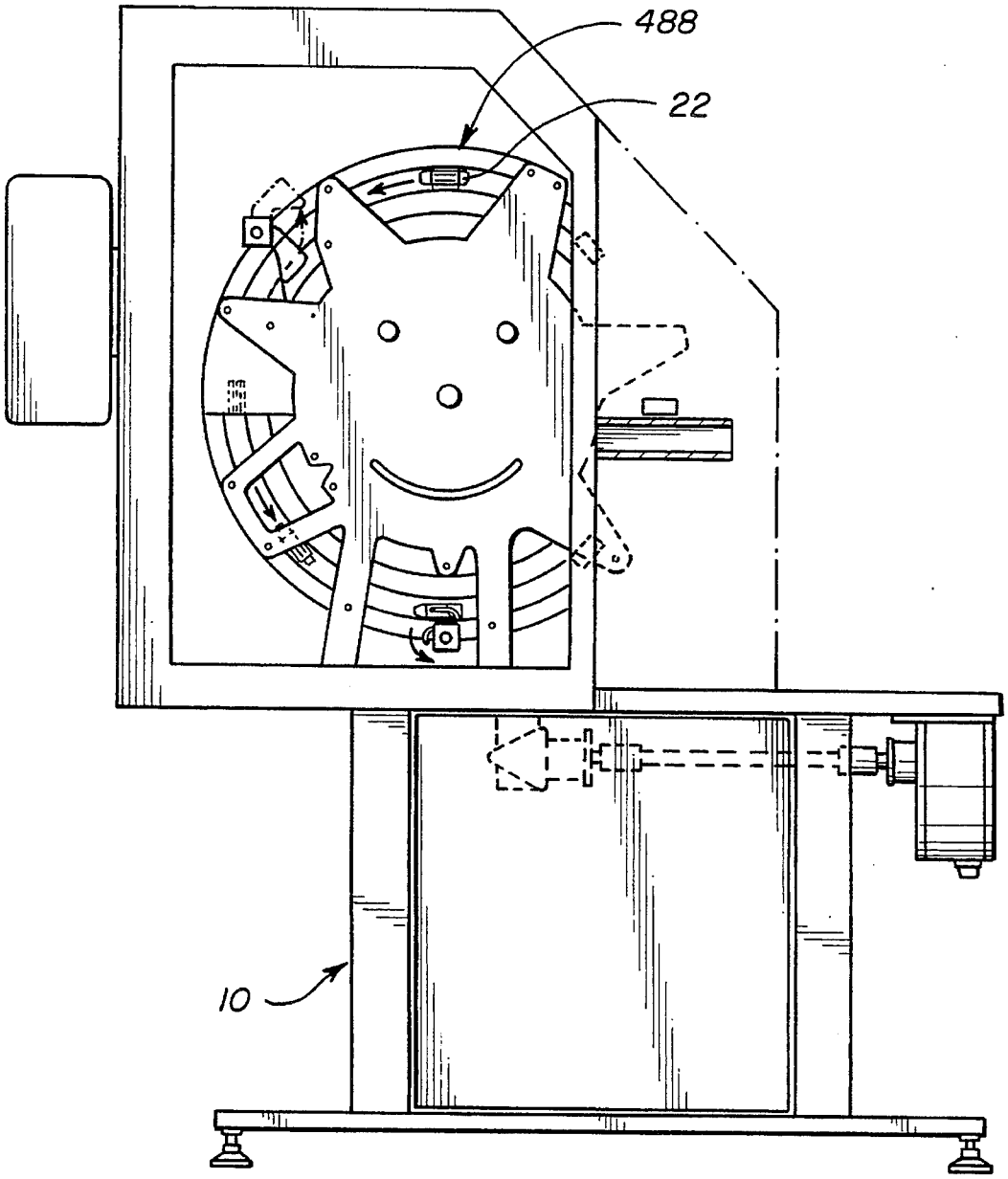
FIG. 36 is an elevational view of a cartoner and carton closing installation as seen on line 36—36 in FIG. 34.

As shown in FIGS. 30 through 34, adjacent the opposite side of the conveyor belt 462 receiving the arrays of blister packages 12 from the tray 100 is a chute 480 leading to a cartoner 488, as shown in FIGS. 35 and 36, the latter of which may be of indexing wheel construction. As the interleaved pairs of arrays of blister packages are positioned on the upper horizontal run 476 of the unloading conveyor belt 462, a suitable pusher element (not shown) simultaneously pushes a predetermined number of interleaved pairs of blister package arrays 12, in this instance three pairs, into the run of the chute 480 so as to be conveyed into the cartoner in the direction of the arrow H, as also illustrated in FIG. 35 of the drawings in schematic representation. The open-ended cartons 22 contained within suitable support apertures 492 in the cartoner 488 have the arrays of blister packages 12 filled therein so as to assume the compact packaging position shown in FIG. 3 of the drawings. Upon the cartoner 488 being rotatably indexed, suitable carton end flap folding structure close the end flaps and seal the latter so as to form a sealed carton construction containing sterilized arrays of blister packages.

Figure 37:
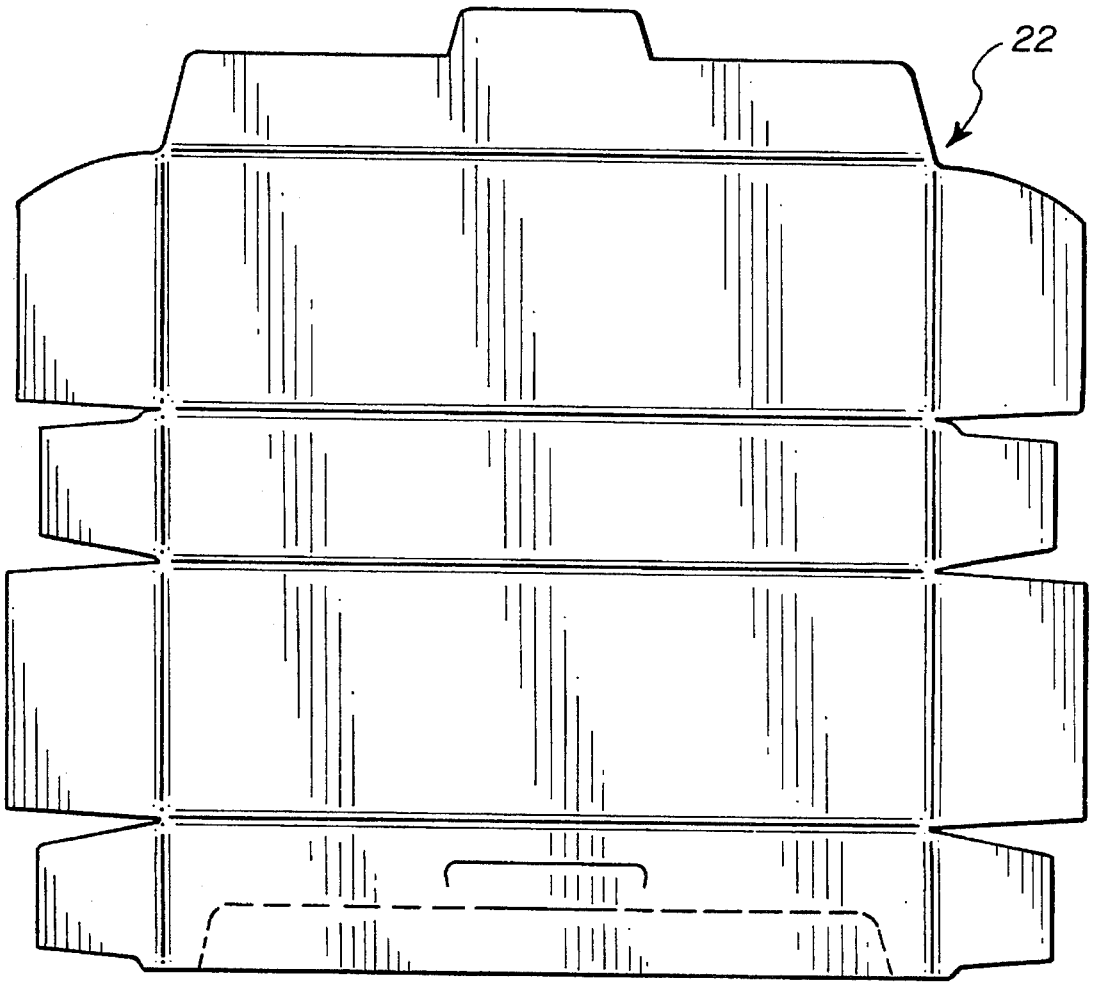
FIG. 37 is a plan view of a carton blank for forming the carton of FIGS. 4 and 5.

As shown in FIG. 37, the carton may be prepared from a suitable carton blank having front side and end walls with flap configuration of a construction widely used in the carton producing industry, and wherein the cartons may be folded and glued in a manner well known in the technology.

Figure 39:
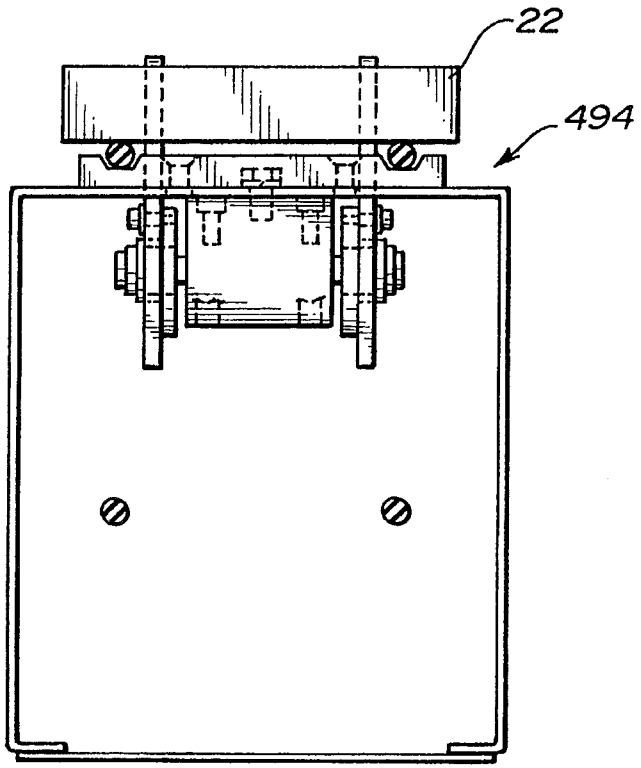
FIG. 39 is an end view of the filled carton stop assembly.
Figure 38:
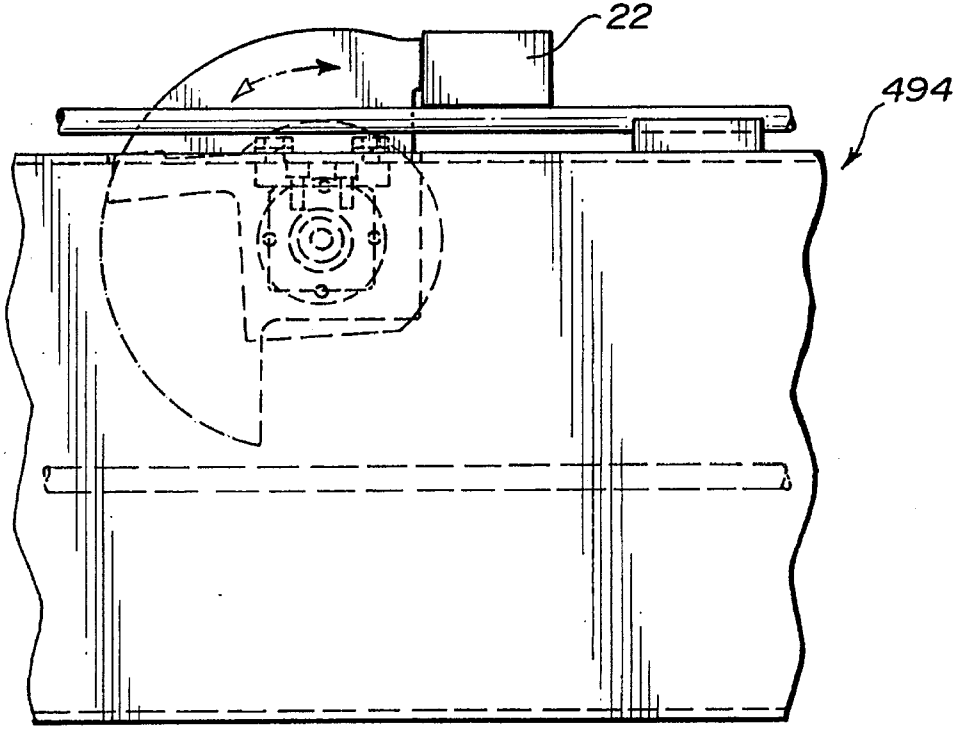
FIG. 38 is a side elevational view of a filled carton stop assembly.
Figure 42:
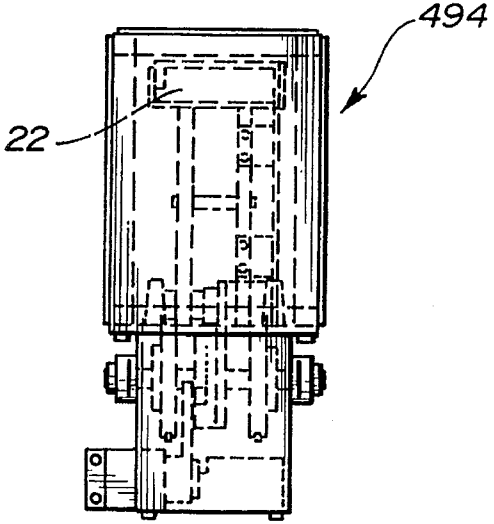
FIG. 42 is an end view of the rotary carton placement unit.
Figure 41:
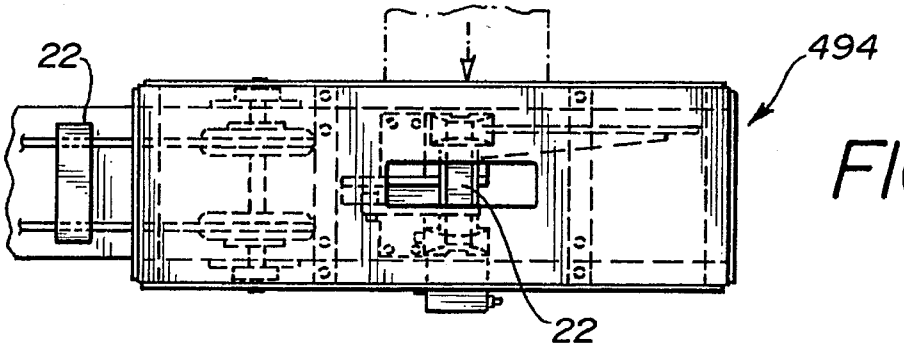
FIG. 41 is a top plan view of the rotary carton placement unit.
Figure 40:
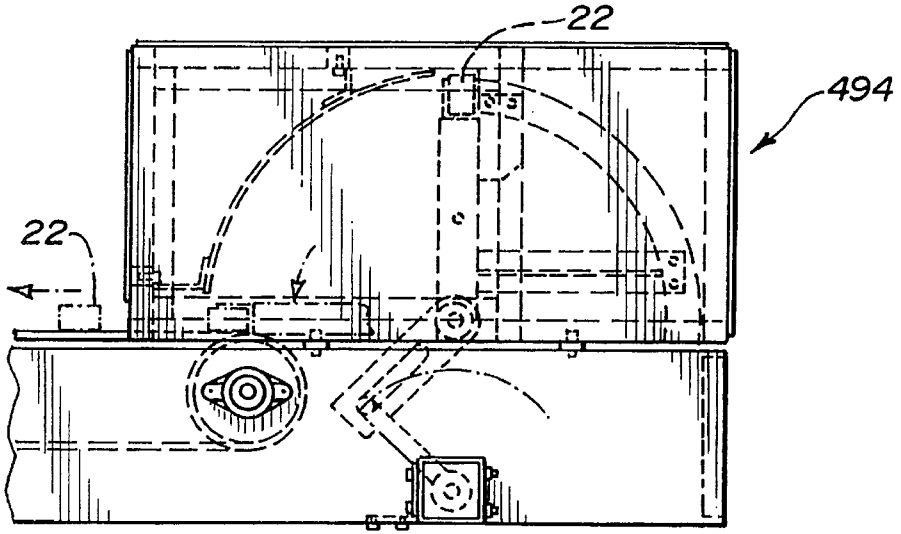
FIG. 40 is a side view of a rotary carton placement unit as seen along line 40—40 in FIG. 7.
Figure 44:
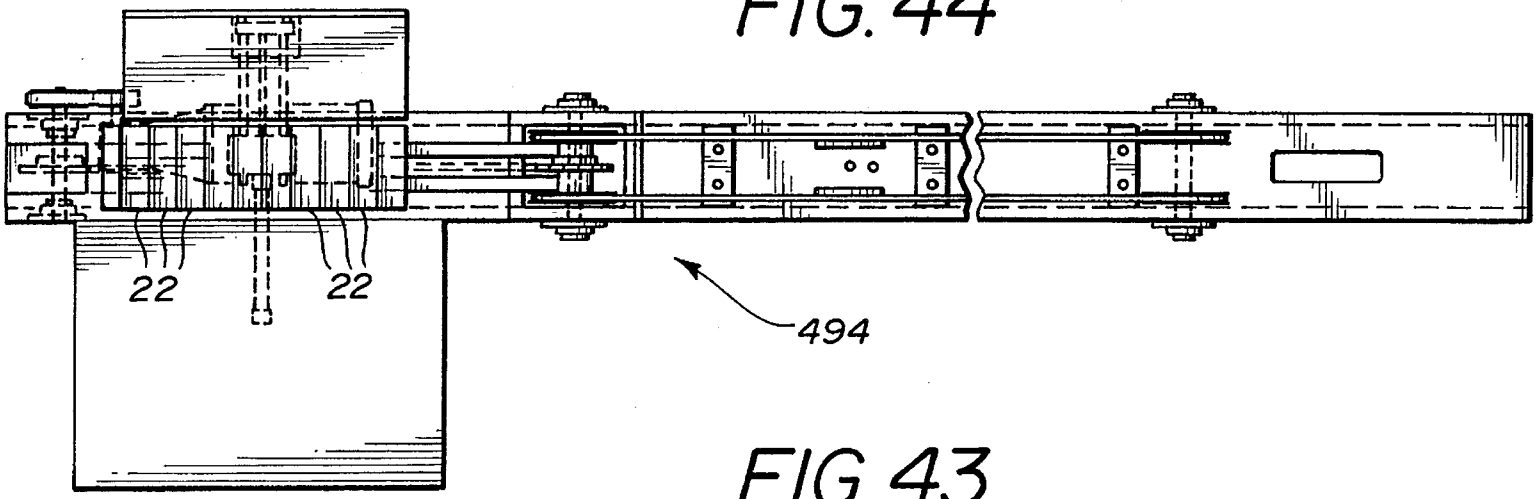
FIG. 44 is a top plan view of the carton back-log conveyor assembly.
Figure 43:
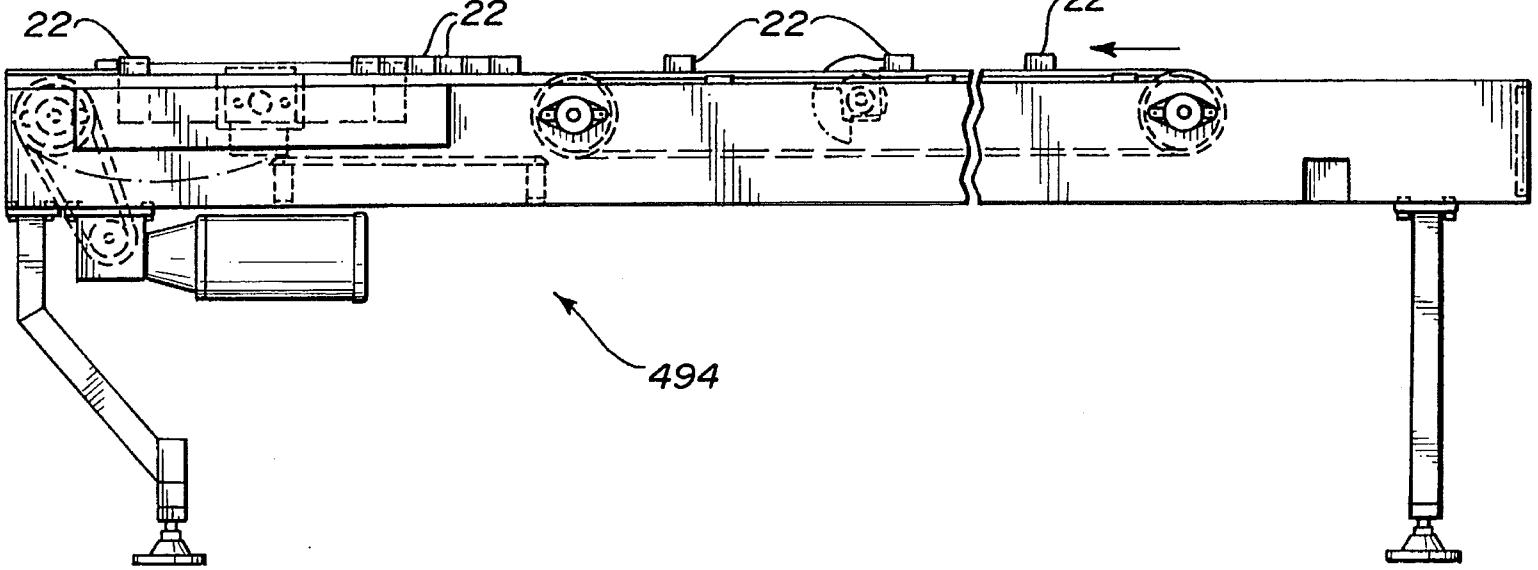
FIG. 43 is a side elevational view of a carton back-log conveyor assembly as seen along line 43— 43 in FIG. 7.

As shown in FIGS. 38 and 39, cartons 22 are conveyed from the cartoner 488 into a suitable off-loading conveyor system 494 so as to be transported past a stop mechanism spacing successive cartons for carton weighing and subsequent labelling procedures, and then their further handling. The displacement and movement of the cartons is illustrated in FIGS. 40 through 44 showing a belt conveyor whereby the sealed cartons upon egressing from the cartoner 488 are indexed individually forwardly in the direction up to the stop so as to enable individual spaced apart cartons to be weighed and labelled and thereafter assembled as the belt conveyor is indexed forwardly by a belt drive unit for further handling.

Figure 45:
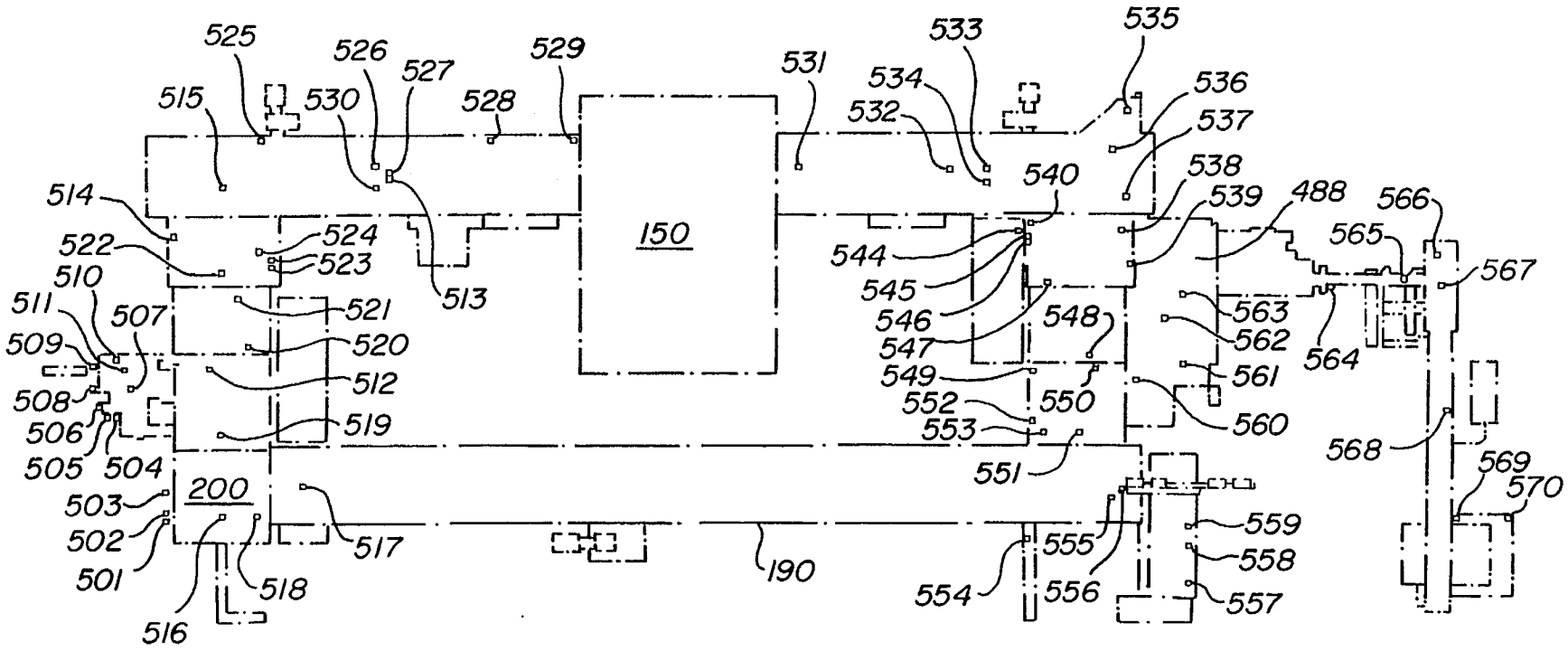
FIG. 45 is a schematic layout of the overall apparatus showing the positioning of various control sensors for regulating the apparatus functions.

As shown in FIG. 45 of the drawings, schematically represented are a plurality of positioning and control sensors which are located along the path of conveyance of the apparatus 10 for sterilizing and secondary packaging into cartons 22 by the arrays of blister packages 12.

Although the functioning and activation of various of the operative components; in effect, tray tilting, stacking and unstacking sequences, may be implemented through the use of pneumatically-operated devices, it is of course possible to contemplate the employment instead thereof, or in conjunction therewith, of hydraulically-operated, mechanical or electro-mechanical devices.

Operation of the apparatus 10 in conjunction with the functioning of the sensors of FIG. 45 is now described hereinbelow:

At the discharge end of the return conveyor for the empty trays, the latter of which are lined up in series, a sensor 517 is adapted to determine the presence of a leading end of a tray 100 and, when required, enable the tray to be advanced to the tray upending position which is sensed by the sensors 516, 158.

As the apparatus commences operation, position sensors 501 through 503 are adapted to activate the mechanism for upending the empty tray 100 and to move the latter forwardly into position adjacent the loading conveyor arrangement 50, as sensed by sensors 519 and 512.

Concurrently, at the array input station 30, the sensors 506, 508,509 will provide for Sensing the positioning of the arrays of blister packages on the pick-up and rotating assembly 70, the folding of the arrays of blister packages 12 and the advance thereof by the pusher 52, as sensed by the sensor 511 into the loading conveyor 62. Sensor 510 then, in conjunction with sensor 507, determines the filled condition of the vertical run of the loading belt conveyor 62 and enable activation of the comb-like pusher 79 for advancing a stack of interleaved blister package arrays into a vertical row of spaces 102 in the upended tray 100. The tray may then be indexed so as to enable sequential or successive stacks of interleaved arrays of blister packages to be moved by the comb-like pusher 79 into the successive rows of spaces in the tray 100 until the latter is completely filled.

Thereafter, upon the final row of spaces having been filled, sensor 520 will enable the tray to be tilted into its initial horizontal position and advanced forwardly to the upstacker where sensors 521 through 524 will control the positions thereof so as to enable further filled trays to be superimposed thereon in a stacked condition. The sensor 514 will then enable the stacked trays to be moved onto the loading conveyor leading to the sterilization chamber 150 or autoclave, and the sensors 515 and 525 will sense the presence of the stacked trays. This will activate the drive for the conveyor towards the sterilization chamber and upon the stacked trays reaching the sensors 526 through 529, for example two the successive stacks of filled trays, a pusher mechanism in the roller conveyor will advance the trays 100 into the sterilization chamber 150.

The sterilization chamber 150 is normally equipped with vertically slidable, upwardly closable inlet and discharge doors (not shown). During sterilization, both doors are in an upwardly closed position so as to seal the trays within the chamber 150. When the sterilization cycle has been completed, the discharge door is slid downwardly into a chamber-opening position to enable the trays to be conveyed out of the chamber. However, in the event that sensors in the sterilization chamber detect conditions that the desired sterilization has not or only incompletely been effectuated, the discharge door will not open, and a suitable alarm, such as an audio/visual alarm or the like, will give indication of this condition so as to afford servicing personnel to undertake appropriate corrective action, and to enable the operating of the apparatus to again commence.

Upon proper completion of the sterilizing of the blister package arrays which are stacked in the trays, the discharge conveyor, which includes the tray location and position sensors 531 through 535, permits the trays to be advanced to the downstacker wherein the sensors 544, 545, 546 facilitate unstacking of the trays into individual separated trays which are advanced and upended in alignment with the unloading conveyor 440, activation thereof being implemented through the sensing of the presence of the upended trays and indexing of the unloading conveyor such that a pusher is activated to transfer vertical rows of sterilized blister package arrays into the interspaces between the fingers of the unloading belt conveyor 462, and thereafter facilitating a further pusher to advance predetermined quantities of the interleaved paired blister package arrays into the cartoner 488 for packaging into cartons 22.

The trays which have been emptied are then serially returned into their horizontal positions and sensed by the sensors 549 through 553 and elevated, as sensed by the sensors 560 and 554 through 559, onto the infeed end of a conveyor for reconveyance towards the other end thereof so as to be ready for reuse for a further batch of trays of blister packages which are to be sterilized and packaged into cartons.

While there has been shown and described what are considered to be preferred embodiments of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. An apparatus for the sterilization of arrays of interconnected blister packages each containing a contact lens in a sterile environment; comprising:

(a) a pick-up and rotating arrangement for receiving successive pairs of said arrays and orienting each of said pairs into predetermined relationship with each other;

(b) a shuttle conveyor assembly including support structure for a plurality of said oriented pairs of arrays; a transfer element operatively associated with said pick-up and rotating arrangement and said shuttle conveyor assembly for sequentially transferring said plurality of oriented pairs of arrays from said pick-up and rotating arrangement to said support structure on said conveyor shuttle assembly;

(c) at least one tray having a series of adjacently located rows of array-receiving spaces for housing one said pair of arrays in respectively each said space, said at least one tray being movable into position proximate said shuttle conveyor assembly;

(d) a pusher structure operatively associated with said shuttle conveyor assembly for transferring a predetermined quantity of said arrays from said support structure into the spaces in said at least one tray;

(e) a sterilization chamber for receiving said at least one tray; and a transport installation for conveying said at least one array-filled tray into said sterilization chamber for the sterilization of the arrays of blister packages housed in said at least one tray in said chamber.

2. An apparatus as claimed in claim 1, wherein said pick-up and rotating arrangement comprises a vacuum unit including means for engaging a pair of said arrays; and operating structure for pivoting said pair of arrays into a mutually interleaved orientation.

3. An apparatus as claimed in claim 2, wherein said array engaging means comprises pneumatically-actuated arm members of a manifold connected to said vacuum unit for pivoting said pair of arrays into said interleaved orientation.

4. An apparatus as claimed in claim 2, wherein said vacuum unit includes suctioning means for grippingly contacting said pair of arrays during the pivoting thereof into the interleaved position for said arrays.

5. An apparatus as claimed in claim 1, wherein said transfer element comprises a pusher member for slidingly advancing pairs of arrays into successive spaces formed between each of a plurality radially outwardly extending fingers on said array support structure of the shuttle conveyor assembly.

6. An apparatus as claimed in claim 5, wherein drive means impart indexing advancing movements to an endless belt conveyor of said conveyor assembly, said support structure comprising a plurality of said fingers spaced about the peripheral extent of said loop conveyor, said pusher element sequentially advancing oriented pairs of said arrays from said pick-up and rotating arrangement so as to position one pair of said arrays in each respective space between adjacent fingers on said endless belt conveyor.

7. An apparatus as claimed in claim 6, wherein a slide guide mounts said pusher element for reciprocatory movement relative to said pick-up and rotating arrangement transversely of the direction of the indexing advance of said endless belt conveyor.

8. An apparatus as claimed in claim 6, wherein said endless belt conveyor has a vertical run, said pairs of arrays being filled into the spaces between the fingers along the extent of said vertical run, said at least one tray having a plurality of said rows of spaces arranged adjacent each other, each said row of spaces being successively positionable in alignment with the spaces containing said arrays between the fingers along the vertical run of said endless belt conveyor, said pusher structure having a plurality of comb-shaped protrusions commensurate with the number of spaces between the fingers on said vertical run of said endless conveyor belt advanceable into the spaces between said fingers, and actuating means for advancing said pusher structure into said endless belt conveyor so as to concurrently transfer the arrays contained in the spaces between said fingers into the therewith aligned row of spaces in said at least one tray.

9. An apparatus as claimed in claim 8, wherein actuating means index said at least one tray to successively align vertical rows of spaces therein with the vertical run of said endless conveyor belt upon filling of a preceding row of said spaces in said at least one tray for filling said rows of spaces in said tray with paired arrays of blister packages.

10. An apparatus as claimed in claim 8, wherein said at least one tray is normally maintained in a layflat horizontal condition during conveyance thereof through said apparatus.

11. An apparatus as claimed in claim 10, wherein pivoting means tilts said at least one tray into an upended position at said shuttle conveyor assembly to successively align vertically extending rows of spaces in said at least one tray with the spaces between the fingers along the vertical run of said endless conveyor belt to facilitate the transfer of said pairs of arrays from said endless conveyor belt for filling said at least one tray.

12. An apparatus as claimed in claim 11, wherein said pivoting means tilts said at least one tray into the normal horizontal position thereof subsequent to filling the rows of spaces in said at least one tray with said paired arrays.

13. An apparatus as claimed in claim 1, wherein said transport installation includes an upstacking mechanism along the path of conveyance of said at least one tray between said shuttle conveyor assembly and said sterilization chamber so as to stack at least two of said array-filled trays in vertical superposition.

14. An apparatus as claimed in claim 13, wherein said transport installation comprises roller tracks for conveying said at least two stacked trays from said upstacking mechanism into said sterilization chamber.

15. An apparatus as claimed in claim 14, wherein said roller tracks include drive means for imparting rotation to at least portions of the roller tracks for advancing said trays from said shuttle conveyor assembly into said sterilization chamber.

16. An apparatus as claimed in claim 15, wherein said transport installation comprises further roller tracks extending from a discharge outlet for said trays from said sterilization chamber, said further roller track communicating with a tray unloading shuttle conveyor for transferring the arrays contained in said tray towards a cartoner.

17. An apparatus as claimed in claim 1, wherein said sterilization chamber comprises an autoclave.

18. An apparatus for the secondary packaging into cartons of arrays of interconnected blister packages each containing a contact lens in a sterile environment, a plurality of said arrays being arranged in rows of spaces in at least one tray; comprising:

(a) transport means for conveying said at least one tray from a sterilization chamber in which said arrays are collectively sterilized;

(b) a shuttle conveyor assembly for receiving said arrays from said at least one tray; said shuttle conveyor assembly including an endless conveyor belt having a plurality of spaced outwardly extending fingers along the peripheral extent thereof, said transport means conveying said at least one tray to said shuttle conveyor assembly;

(c) pivoting means for tilting said at least one tray into an upended position at said shuttle conveyor assembly to successively align vertically oriented rows of spaces in said at least one tray with the spaces between the finger along a vertical run of said endless conveyor belt;

(d) a pusher structure including a plurality of spaced protrusions being extendable into the spaces of said at least one tray for transferring the arrays in each row of spaces into aligned spaces between the fingers on the vertical run of said endless conveyor belt;

(e) a cartoner including positioning means for successively aligning open-ended cartons with an upper horizontal run of said endless conveyor belt; and (f) a sliding pusher mounted for reciprocation proximate said upper run of the endless belt conveyor for transferring successive predetermined numbers of arrays from said upper horizontal run of the endless conveyor belt into a respective carton in said cartoner.

19. An apparatus as claimed in claim 18, wherein chute means interconnect the upper horizontal run of said endless belt conveyor with said cartoner, said sliding pusher sliding successive of said arrays along said chute means into carton aligned by said cartoner with a discharge end of said chute means.

20. An apparatus as claimed in claim 18, wherein said cartoner comprises a rotatably indexed wheel structure, said open-ended cartons being insertable into through-apertures in said wheel structure; and drive means for rotating said wheel structure in synchronism with the insertion of arrays into said cartons by said sliding pusher.

21. An apparatus as claimed in claim 20, wherein said wheel structure includes elements for closing end flaps on said cartons subsequent to filling of said cartons with said arrays and for sealing said closed cartons.

22. An apparatus as claimed in claim 21, wherein conveyor means communicate with said cartoner for sequentially transporting array-filled cartons from said wheel structure to carton weighing and labeling stations and for collecting said cartons for further handling.

23. An apparatus as claimed in claim 18, wherein said transport means conveys a plurality of stacked of said trays from said sterilization chamber towards said shuttle conveyor assembly; and a tray downstacking mechanism for separating said stacked trays and forwarding individual of said trays towards said shuttle conveyor assembly in predetermined spaced advance.

24. An apparatus as claimed in claim 23, wherein pivoting means tilts said unstacked trays in sequence into an upended position to facilitate transfer of the arrays housed therein into the vertical run of said endless belt conveyor by said pusher structure.

25. An apparatus as claimed in claim 24, wherein said pivoting means returns said tray into a horizontal position subsequent to completion of the indexed transfer of the arrays therefrom to said endless belt conveyor.

26. An apparatus as claimed in claim 18, wherein said transport means comprises a roller track arrangement having at least portions rotatably driven for conveyance of said at least one tray.

27. An apparatus as claimed in claim 26, wherein said roller track arrangement includes a track segment for returning emptied trays to an initial starting locating for filling said trays with paired arrays of blister packages.

28. An apparatus for the sterilization and secondary packaging into cartons of arrays of interconnected blister packages each containing a contact lens in a sterile environment; comprising:

(a) a pick-up and rotating arrangement for receiving successive pairs of said arrays and orienting each of said pairs into predetermined relationship with each other;

(b) a shuttle conveyor assembly including support structure for a plurality of said oriented pairs of arrays; a transfer element operatively associated with said pick-up and rotating arrangement and said shuttle conveyor assembly for sequentially transferring said plurality of oriented pairs of arrays from said pick-up and rotating arrangement to said support structure on said conveyor shuttle assembly;

(c) at least one tray having a series of adjacently located rows of array-receiving spaces for housing one said pair of arrays in respectively each said space, said at least one tray being movable into position proximate said shuttle conveyor assembly;

(d) a pusher structure operatively associated with said shuttle conveyor assembly for transferring a predetermined quantity of said arrays from said support structure into the spaces in said at least one tray;

(e) a sterilization chamber for receiving said at least one tray; and a transport installation for conveying said at least one array-filled tray into said sterilization chamber for the collective sterilization of the arrays of blister packages housed in said at least one tray within said chamber;

(f) transport means for conveying said at least one tray from said sterilization chamber in which sterilizing of said arrays has been completed;

(g) a further shuttle conveyor assembly for receiving said sterilized arrays from said at least one tray; said further shuttle conveyor assembly including an endless conveyor belt having a plurality of spaced outwardly extending fingers along the peripheral extent thereof, said transport means conveying said at least one tray to said shuttle conveyor assembly;

(h) further pivoting means for tilting said at least one tray into an upended position at said further shuttle conveyor assembly to successively align vertically oriented rows of spaces in said at least one tray with the spaces between the finger along a vertical run of said endless conveyor belt;

(i) a further pusher structure including a plurality of spaced protrusions being extendable into the spaces of said at least one tray for transferring the arrays in each row of spaces into aligned spaces between the fingers on the vertical run of said endless conveyor belt;

(j) a cartoner including positioning means for successively aligning open-ended cartons with an upper horizontal run of said endless conveyor belt; and (k) a sliding pusher mounted for reciprocation proximate said upper horizontal run of the endless belt conveyor for transferring successive predetermined numbers of arrays from said upper horizontal run of the endless conveyor belt into a respective carton in said cartoner.

29. An apparatus as claimed in claim 28, wherein said pick-up and rotating arrangement comprises a vacuum unit including means for engaging a pair of said arrays; and operating structure for pivoting said pair of arrays into a mutually interleaved orientation.

30. An apparatus as claimed in claim 29, wherein said array engaging means comprises pneumatically-actuated arm members of a manifold connected to said vacuum unit for pivoting said pair of arrays into said interleaved orientation.

31. An apparatus as claimed in claim 29, wherein said vacuum unit includes suctioning means for grippingly contacting said pair of arrays during the pivoting thereof into the interleaved position for said arrays.

32. An apparatus as claimed in claim 28, wherein said transfer element comprises a pusher member for slidingly advancing pairs of arrays into successive spaces formed between each of a plurality of radially outwardly extending fingers on said array support structure of the shuttle conveyor assembly.

33. An apparatus as claimed in claim 32, wherein drive means impart indexing advancing movements to an endless belt conveyor of said conveyor assembly, said support structure comprising a plurality of said fingers spaced about the peripheral extent of said loop conveyor, said pusher element sequentially advancing oriented pairs of said arrays from said pick-up and rotating arrangement so as to position one pair of said arrays in each respective space between adjacent fingers on said endless belt conveyor.

34. An apparatus as claimed in claim 33, wherein a slide guide mounts said pusher element for reciprocatory movement relative to said pick-up and rotating arrangement transversely of the direction of the indexing advance of said endless belt conveyor.

35. An apparatus as claimed in claim 33, wherein said endless belt conveyor has a vertical run, said pairs of arrays being filled into the spaces between the fingers along the extent of said vertical run, said at least one tray having a plurality of said rows of spaces arranged adjacent each other, each said row of spaces being successively positionable in alignment with the spaces containing said arrays between the fingers along the vertical run of said endless belt conveyor, said pusher structure having a plurality of comb-shaped protrusions commensurate with the number of spaces between the fingers on said vertical run of said endless conveyor belt advanceable into the spaces between said fingers, and actuating means for advancing said pusher structure into said endless belt conveyor so as to concurrently transfer the arrays contained in the spaces between said fingers into the therewith aligned row of spaces in said at least one tray.

36. An apparatus as claimed in claim 35, wherein actuating means index said at least one tray to successively align vertical rows of spaces therein with the vertical run of said endless conveyor belt upon filling of a preceding row of said spaces in said at least one tray for filling said rows of spaces in said tray with paired arrays of blister packages.

37. An apparatus as claimed in claim 35, wherein said at least one tray is normally maintained in a layflat horizontal condition during conveyance thereof through said apparatus.

38. An apparatus as claimed in claim 37, wherein pivoting means tilts said at least one tray into an upended position at said shuttle conveyor assembly to successively align vertically extending rows of spaces in said at least one tray with the spaces between the fingers along the vertical run of said endless conveyor belt to facilitate the transfer of said pairs of arrays from said endless conveyor belt for filling said at least one tray.

39. An apparatus as claimed in claim 38, wherein said pivoting means tilts said at least one tray into the normal horizontal position thereof subsequent to filling the rows of spaces in said at least one tray with said paired arrays.

40. An apparatus as claimed in claim 28, wherein said transport installation includes an upstacking mechanism along the path of conveyance of said at least one tray between said shuttle conveyor assembly and said sterilization chamber so as to stack at least two of said array-filled trays in vertical superposition.

41. An apparatus as claimed in claim 40, wherein said transport installation comprises roller tracks for conveying said at least two stacked trays from said upstacking mechanism into said sterilization chamber.

42. An apparatus as claimed in claim 41, wherein said roller tracks include drive means for imparting rotation to at least portions of the roller tracks for advancing said trays from said shuttle conveyor assembly into said sterilization chamber.

43. An apparatus as claimed in claim 28, wherein said transport means comprises roller tracks extending from a discharge outlet for said trays from said sterilization chamber, said roller track communicating with said further tray unloading shuttle conveyor assembly for transferring the arrays contained in said tray to said cartoner.

44. An apparatus as claimed in claim 28, wherein said sterilization chamber comprises an autoclave.

45. An apparatus as claimed in claim 28, wherein chute means interconnect the upper horizontal run of said endless belt conveyor with said cartoner, said sliding pusher sliding successive of said arrays along said chute means into carton aligned by said cartoner with a discharge end of said chute means.

46. An apparatus as claimed in claim 28, wherein said cartoner comprises a rotatably indexed wheel structure, said open-ended cartons being insertable into through-apertures in said wheel structure; and drive means for rotating said wheel structure in synchronism with the insertion of arrays into said cartons by said sliding pusher.

47. An apparatus as claimed in claim 46, wherein said wheel structure includes elements for closing end flaps on said cartons subsequent to filling of said cartons with said arrays and for sealing said closed cartons.

48. An apparatus as claimed in claim 46, wherein conveyor means communicate with said cartoner for sequentially transporting array-filled cartons from said wheel structure to carton weighing and labeling stations and for collecting said cartons for further handling.

49. An apparatus as claimed in claim 28, wherein said transport means conveys a plurality of stacked of said trays from said sterilization chamber towards said further shuttle conveyor assembly; and a tray downstacking mechanism for separating said stacked trays and forwarding individual of said trays towards said further shuttle conveyor assembly in predetermined spaced advance.

50. An apparatus as claimed in claim 49, wherein further pivoting means tilts said unstacked trays in sequence into an upended position to facilitate transfer of the arrays housed therein into the vertical run of said endless belt conveyor by said further pusher structure.

51. An apparatus as claimed in claim 50, wherein said further pivoting means returns said tray into a horizontal position subsequent to completion of the indexed transfer of the arrays therefrom to said endless belt conveyor.

52. An apparatus as claimed in claim 28, wherein said transport means comprises a roller track arrangement having at least portions rotatably driven for conveyance of said at least one tray.

53. An apparatus as claimed in claim 52, wherein said roller track arrangement includes a track segment for returning emptied trays to an initial starting locating for filling said trays with paired array of blister packages.

54. An apparatus as claimed in claim 28, wherein a plurality of sensors are positioned along the path of advance of said at least one tray through said apparatus for controlling the functions of the operative components of said apparatus.

55. A method for the sterilization of arrays of interconnected blister packages each containing a contact lens in a sterile environment; comprising:

(a) actuating a pick-up and rotating arrangement for receiving successive pairs of said arrays and orienting each of said pairs into predetermined relationship with each other;

(b) actuating a shuttle conveyor assembly including support structure for a plurality of said oriented pairs of arrays through a transfer element operatively associated in synchronism with said pick-up and rotating arrangement and said shuttle conveyor assembly for sequentially transferring said plurality of oriented pairs of arrays from said pick-up and rotating arrangement to said support structure on said conveyor shuttle assembly;

(c) moving at least one tray having a series of adjacently located rows of array-receiving spaces for housing one said pair of arrays in respectively each said space into position proximate said shuttle conveyor assembly;

(d) displacing a pusher structure operatively associated with said shuttle conveyor assembly for transferring a predetermined quantity of said arrays from said support structure into the spaces in said at least one tray; and (e) conveying said at least one array-filled tray into a sterilization chamber for the collective sterilization of the arrays of blister packages housed in said at least one tray in said chamber.

56. A method as claimed in claim 55, wherein said pick-up and rotating arrangement comprises a vacuum unit operated for engaging a pair of said arrays; and pivoting said pair of arrays into a mutually interleaved orientation.

57. A method as claimed in claim 56, wherein said arrays are engaged by pneumatically-actuated arm members of a manifold connected to said vacuum unit for pivoting said pair of arrays into said interleaved orientation.

58. A method as claimed in claim 56, wherein said vacuum unit includes suctioning means grippingly contacting said pair of arrays during the pivoting thereof into the interleaved orientation.

59. A method as claimed in claim 55, wherein said transfer element comprises a pusher member slidingly advancing pairs of arrays into successive spaces formed between each of a plurality radially outwardly extending fingers on said array support structure of the shuttle conveyor assembly.

60. A method as claimed in claim 59, wherein drive means impart indexing advancing movements to an endless belt conveyor of said conveyor assembly, said support structure comprising a plurality of said fingers spaced about the peripheral extent of said loop conveyor, said pusher element sequentially advancing oriented pairs of said arrays from said pick-up and rotating arrangement so as to position one pair of said arrays in each respective space between adjacent fingers on said endless belt conveyor.

61. A method as claimed in claim 60, wherein a slide guide reciprocates said pusher element relative to said pick-up and rotating arrangement transversely of the direction of the indexing advance of said endless belt conveyor.

62. A method as claimed in claim 60, wherein said endless belt conveyor has a vertical run, said pairs of arrays being filled into the spaces between the fingers along the extent of said vertical run, said at least one tray having a plurality of said rows of spaces arranged adjacent each other, each said row of spaces being successively positionable in alignment with the spaces containing said arrays between the fingers along the vertical run of said endless belt conveyor, said pusher structure having a plurality of comb-shaped protrusions commensurate with the number of spaces between the fingers on said vertical run of said endless conveyor belt advanceable into the spaces between said fingers, and advancing said pusher structure into said endless belt conveyor so as to concurrently transfer the arrays contained in the spaces between said fingers into the therewith aligned row of spaces in said at least one tray.

63. A method as claimed in claim 62, wherein said at least one tray is indexed to successively align vertical rows of spaces therein with the vertical run of said endless conveyor belt upon filling of a preceding row of said spaces in said at least one tray for filling said rows of spaces in said tray with paired arrays of blister packages.

64. A method as claimed in claim 62, wherein said at least one tray is normally maintained in a layflat horizontal condition during conveyance thereof through said apparatus.

65. A method as claimed in claim 64, wherein said at least one tray is tilted into an upended position at said shuttle conveyor assembly to successively align vertically extending rows of spaces in said at least one tray with the spaces between the fingers along the vertical run of said endless conveyor belt to facilitate the transfer of said pairs of arrays from said endless conveyor belt for filling said at least one tray.

66. A method as claimed in claim 65, wherein said at least one tray is tilted into a normal horizontal position thereof subsequent to filling the rows of spaces in said at least one tray with said paired arrays.

67. A method as claimed in claim 55, wherein said transport installation includes an upstacking mechanism along the path of conveyance of said at least one tray between said shuttle conveyor assembly and said sterilization chamber for stacking at least two of said array-filled trays in vertical superposition.

68. A method as claimed in claim 67, wherein said transport installation comprises roller tracks for conveying said at least two stacked trays from said upstacking mechanism into said sterilization chamber.

69. A method as claimed in claim 68, wherein rotation is imparted to at least portions of the roller tracks for advancing said trays from said shuttle conveyor assembly into said sterilization chamber.

70. A method as claimed in claim 69, wherein said transport installation comprises further roller tracks extending from a discharge outlet for said trays from said sterilization chamber, said further roller track communicating with a tray unloading shuttle conveyor for transferring the arrays contained in said tray towards a cartoner.

71. A method as claimed in claim 55, wherein said sterilization chamber comprises an autoclave.

72. A method for the secondary packaging into cartons of arrays of interconnected blister packages each containing a contact lens in a sterile environment, a plurality of said arrays being arranged in rows of spaces in at least one tray; comprising:

(a) conveying said at least one tray from a sterilization chamber in which said arrays are collectively sterilized;

(b) actuating a shuttle conveyor assembly for receiving said arrays from said at least one tray; said shuttle conveyor assembly including an endless conveyor belt having a plurality of spaced outwardly extending fingers along the peripheral extent thereof, and conveying said at least one tray to said shuttle conveyor assembly;

(c) tilting said at least one tray into an upended position at said shuttle conveyor assembly to successively align vertically oriented rows of spaces in said at least one tray with the spaces between the finger along a vertical run of said endless conveyor belt;

(d) extending a pusher structure including a plurality of spaced protrusions into the spaces of said at least one tray for transferring the arrays in each row of spaces into aligned spaces between the fingers on the vertical run of said endless conveyor belt;

(e) successively aligning open-ended cartons with an upper horizontal run of said endless conveyor belt; and (f) reciprocating a sliding pusher said upper run of the endless belt conveyor for transferring successive predetermined numbers of arrays from said upper horizontal run of the endless conveyor belt into a respective one of said cartons.

73. A method as claimed in claim 72, wherein the upper horizontal run of said endless belt conveyor communicates with said cartons, and sliding successive of said arrays along into respective cartons successively aligned therewith.

74. A method as claimed in claim 72, wherein a cartoner comprising a rotatably indexed wheel structure has said open-ended cartons inserted into through-apertures in a cartoner wheel structure; and rotating said wheel structure in synchronism with the successive insertion of arrays into said cartons.

75. A method as claimed in claim 74, wherein said wheel structure includes elements for closing end flaps on said cartons subsequent to filling of said cartons with said arrays and for sealing said closed cartons.

76. A method as claimed in claim 75, wherein array-filled cartons are sequentially conveyed from said wheel structure to carton weighing and labeling stations and for collecting said cartons for further handling.

77. A method as claimed in claim 72, wherein a plurality of stacks of said trays are conveyed from said sterilization chamber towards said shuttle conveyor assembly; and a tray downstacking mechanism separates said stacked trays and forwards individual of said trays towards said shuttle conveyor assembly in predetermined spaced advance.

78. A method as claimed in claim 77, wherein said unstacked trays are tilted in sequence into an upended position to facilitate transfer of the arrays housed therein into the vertical run of said endless belt conveyor.

79. A method as claimed in claim 78, wherein said trays are tilted into a normally horizontal position subsequent to completion of the indexed transfer of the arrays therefrom to said endless belt conveyor.

80. A method as claimed in claim 72, wherein a roller track arrangement has at least portions thereof rotatably driven for conveyance of said at least one tray.

81. A method as claimed in claim 80, wherein emptied trays are conveyed to an initial starting locating for filling said trays with paired arrays of blister packages.

82. A method for the sterilization and secondary packaging into cartons of arrays of interconnected blister packages each containing a contact lens in a sterile environment; comprising:

(a) actuating a pick-up and rotating arrangement for receiving successive pairs of said arrays and orienting each of said pairs into predetermined relationship with each other;

(b) activating a shuttle conveyor assembly including support structure for a plurality of said oriented pairs of arrays through a transfer element operatively associated in synchronism with said pick-up and rotating arrangement and said shuttle conveyor assembly for sequentially transferring said plurality of oriented pairs of arrays from said pick-up and rotating arrangement to said support structure on said conveyor shuttle assembly;

(c) moving at least one tray having a series of adjacently located rows of array-receiving spaces for housing one said pair of arrays in respectively each said space into position proximate said shuttle conveyor assembly;

(d) displacing a pusher structure operatively associated with said shuttle conveyor assembly for transferring a predetermined quantity of said arrays from said support structure into the spaces in said at least one tray;

(e) conveying said at least one array-filled tray into a sterilization chamber for the collective sterilization of the arrays of blister packages housed in said at least one tray within said chamber;

(f) conveying said at least one tray from said sterilization chamber in which sterilizing of said arrays has been completed;

(g) indexing a further shuttle conveyor assembly for receiving said sterilized arrays from said at least one tray; said further shuttle conveyor assembly including an endless conveyor belt having a plurality of spaced outwardly extending fingers along the peripheral extent thereof, said transport means conveying said at least one tray to said shuttle conveyor assembly;

(h) tilting said at least one tray into an upended position at said further shuttle conveyor assembly to successively align vertically oriented rows of spaces in said at least one tray with the spaces between the fingers along a vertical run of said endless conveyor belt;

(i) extending a further pusher structure including a plurality of spaced protrusions into the spaces of said at least one tray for transferring the arrays in each row of spaces into aligned spaces between the fingers on the vertical run of said endless conveyor belt;

(j) successively aligning open-ended cartons with an upper horizontal run of said endless conveyor belt; and (k) transferring successive predetermined numbers of arrays from said upper horizontal run of the endless conveyor belt into a respective therewith aligned carton.

83. A method as claimed in claim 82, wherein said pick-up and rotating arrangement comprises a vacuum unit engaging a pair of said arrays and pivoting said pair of arrays into a mutually interleaved orientation.

84. A method as claimed in claim 83, wherein pneumatically-actuated arm members of a manifold connected to said vacuum unit pivot said pair of arrays into said interleaved orientation.

85. A method as claimed in claim 83, wherein said vacuum unit includes suctioning means for grippingly contacting said pair of arrays during the pivoting thereof into the interleaved orientation.

86. A method as claimed in claim 82, wherein pairs of arrays are slidingly advanced into successive spaces formed between each of a plurality of radially outwardly extending fingers on said array support structure of the shuttle conveyor assembly.

87. A method as claimed in claim 84, wherein indexing advancing movements are imparted to an endless belt conveyor of said conveyor assembly, said support structure comprising a plurality of said fingers spaced about the peripheral extent of said loop conveyor and advancing oriented pairs of said arrays from said pickup and rotating arrangement so as to position one pair of said arrays in each respective space between adjacent fingers on said endless belt conveyor.

88. A method as claimed in claim 86, wherein said endless belt conveyor has a vertical run, said pairs of arrays being filled into the spaces between the fingers along the extent of said vertical run, said at least one tray having a plurality of said rows of spaces arranged adjacent each other, each said row of spaces being successively positionable in alignment with the spaces containing said arrays between the fingers along the vertical run of said endless belt conveyor, a pusher structure having a plurality of comb-shaped protrusions commensurate with the number of spaces between the fingers on said vertical run of said endless conveyor belt advanceable into the spaces between said fingers, and advancing said pusher structure into said endless belt conveyor so as to concurrently transfer the arrays contained in the spaces between said fingers into the therewith aligned row of spaces in said at least one tray.

89. A method as claimed in claim 88, wherein said at least one tray is indexed to successively align vertical rows of spaces therein with the vertical run of said endless conveyor belt upon filling of a preceding row of said spaces in said at least one tray for filling successive said rows of spaces in said tray with paired arrays of blister packages.

90. A method as claimed in claim 88, wherein said at least one tray is normally maintained in a layflat horizontal condition during conveyance thereof through said apparatus.

91. A method as claimed in claim 90, wherein said at least one tray is tilted into an upended position at said shuttle conveyor assembly to successively align vertically extending rows of spaces in said at least one tray with the spaces between the fingers along the vertical run of said endless conveyor belt to facilitate the transfer of said pairs of arrays from said endless conveyor belt for filling said at least one tray.

92. A method as claimed in claim 91, wherein said at least one tray is tilted into the normal horizontal position thereof subsequent to filling the rows of spaces in said at least one tray with said paired arrays.

93. A method as claimed in claim 82, wherein an upstacking mechanism along the path of conveyance of said at least one tray between said shuttle conveyor assembly and said sterilization chamber stacks at least two of said array-filled trays in vertical superposition.

94. A method as claimed in claim 93, wherein roller tracks convey said at least two stacked trays from said upstacking mechanism into said sterilization chamber.

95. A method as claimed in claim 94, wherein rotation is imparted to at least portions of the roller tracks for advancing said trays from said shuttle conveyor assembly into said sterilization chamber.

96. A method as claimed in claim 82, wherein roller tracks extend from a discharge outlet for said trays from said sterilization chamber, said roller track communicating with said further tray unloading shuttle conveyor assembly for transferring the arrays contained in said tray to a cartoner.

97. A method as claimed in claim 82, wherein said sterilization chamber comprises an autoclave.

98. A method as claimed in claim 82, wherein chute means interconnect the upper horizontal run of said endless belt conveyor with a cartoner, for sliding successive of said arrays along said chute means into open-ended cartons aligned by said cartoner with a discharge end of said chute means.

99. A method as claimed in claim 82, wherein said cartoner comprises a rotatably indexed wheel structure, said open-ended cartons being insertable into through-apertures in said wheel structure; and rotating said wheel structure in synchronism with the insertion of arrays into said cartons.

100. A method as claimed in claim 99, wherein end flaps on said cartons are closed subsequent to filling of said cartons with said arrays and sealing said closed cartons.

101. A method as claimed in claim 99, wherein array-filled cartons are sequentially transported from said wheel structure to carton weighing and labeling stations and for collecting said cartons for further handling.

102. A method as claimed in claim 82, wherein a plurality of stacked of said trays are conveyed from said sterilization chamber towards said further shuttle conveyor assembly; and a tray downstacking mechanism separates said stacked trays and forwards individual of said trays towards said further shuttle conveyor assembly in predetermined spaced advance.

103. A method as claimed in claim 102, wherein said unstacked trays are tilted in sequence into an upended position to facilitate transfer of the arrays housed therein into the vertical run of said endless belt conveyor.

104. A method as claimed in claim 103, wherein said trays are tilted into a horizontal position subsequent to completion of the indexed transfer of the arrays therefrom to said endless belt conveyor.

105. A method as claimed in claim 104, wherein emptied trays are reconveyed to an initial starting locating for filling said trays with paired array of blister packages.

106. A method as claimed in claim 82, wherein a plurality of sensors positioned along the path of advance of said at least one tray control the functions of the operative components of an apparatus for implementing the method.

* * * * *